US007960692B2

(12) United States Patent
Dobson et al.

(10) Patent No.: US 7,960,692 B2
(45) Date of Patent: Jun. 14, 2011

(54) ION FOCUSING AND DETECTION IN A MINIATURE LINEAR ION TRAP FOR MASS SPECTROMETRY

(75) Inventors: Gareth S. Dobson, Albuquerque, NM (US); Christie G. Enke, Placitas, NM (US)

(73) Assignee: STC.UNM, Albuquerque, NM (US)

( * ) Notice: Subject to any disclaimer, the term of this patent is extended or adjusted under 35 U.S.C. 154(b) by 1053 days.

(21) Appl. No.: 11/753,455

(22) Filed: May 24, 2007

(65) Prior Publication Data

US 2010/0019143 A1 Jan. 28, 2010

Related U.S. Application Data

(60) Provisional application No. 60/802,969, filed on May 24, 2006, provisional application No. 60/843,809, filed on Sep. 11, 2006, provisional application No. 60/848,745, filed on Oct. 2, 2006, provisional application No. 60/848,748, filed on Oct. 2, 2006, provisional application No. 60/903,119, filed on Feb. 23, 2007.

(51) Int. Cl.
*H01J 49/26* (2006.01)
*H01J 49/40* (2006.01)

(52) U.S. Cl. ..... 250/283; 250/281; 250/282; 250/287

(58) Field of Classification Search ..... 250/281, 250/282, 286, 287, 288, 283
See application file for complete search history.

(56) References Cited

U.S. PATENT DOCUMENTS

| | | | | |
|---|---|---|---|---|
| 2001/0050335 | A1* | 12/2001 | Whitehouse et al. | 250/288 |
| 2006/0071161 | A1* | 4/2006 | Syms | 250/290 |
| 2006/0163472 | A1* | 7/2006 | Marquette | 250/290 |
| 2006/0169884 | A1* | 8/2006 | Syka | 250/282 |
| 2007/0023638 | A1* | 2/2007 | Bateman et al. | 250/287 |
| 2007/0114390 | A1* | 5/2007 | Laskin et al. | 250/288 |
| 2007/0158550 | A1* | 7/2007 | Wells | 250/292 |
| 2008/0191130 | A1* | 8/2008 | Bateman et al. | 250/283 |
| 2009/0261247 | A1* | 10/2009 | Cooks et al. | 250/292 |

OTHER PUBLICATIONS

Ferran et al., "High-Pressure Effects in Miniature Arrays of Quadrupole Analyzers for Residual Gas Analysis", Journal of Vacuum Science and Technology A, 14(3), 1996, pp. 1258-1265.*

* cited by examiner

*Primary Examiner* — David A Vanore
*Assistant Examiner* — Nicole Ippolito Rausch
(74) *Attorney, Agent, or Firm* — Gonzales Patent Services; Ellen Gonzales

(57) ABSTRACT

A miniature linear ion trap (MLIT) with a length of less than 30 mm is provided for ion focusing in the axial plane. The MLIT has multipoles for applying an AC voltage to ions and tubular entrance and exit lenses for applying a DC voltage to the ions. In another aspect, MLIT includes electrodes within the tubular entrance and exit lenses for detection of image current. A method is also provided for applying voltage to the entrance and exit lenses for ion focusing.

47 Claims, 11 Drawing Sheets

ION FOCUSING AND DETECTION IN A MINIATURE LINEAR ION TRAP FOR MASS SPECTROMETRY

PRIORITY CLAIM

The following application claims priority to U.S. Provisional Patent Applications No. 60/802,969, "Equipment and Method for a Miniature Linear Ion Trap Allowing Spatial Focusing and Resolving of Ions According to Mass/Charge Value" filed May 24, 2006, No. 60/843,809, "Equipment and Method for a Miniature Linear Ion Trap Allowing Spatial Focusing and Resolving of Ions According to Mass/Charge Value" filed Sep. 11, 2006, No. 60/848,745, "Method of Focusing Ions for Distance of Flight Mass Spectrometry" filed Oct. 2, 2006, No. 60/848,748, "Method and Apparatus for Use and Application of Non-Destructive Detection for a Miniature Linear Ion Trap" filed Oct. 2, 2006, No. 60/903,119, "Method and Apparatus for Use and Application of Non-Destructive Detection for Mass Spectrometry" filed Feb. 23, 2007, each of which is hereby incorporated by reference.

TECHNICAL FIELD

This invention generally relates to mass spectrometers and more particularly to miniature linear ion traps.

BACKGROUND

Ion traps typically analyze ions using resonant ejection, as described in greater detail in U.S. Pat. No. 4,540,884, which is hereby incorporated by reference. Mass selective ejection can also be performed using linear ion traps, as described in U.S. Pat. No. 6,177,668, which is hereby incorporated by reference.

Both linear (2D) and three dimensional (3D) ion traps are commonly used for mass/charge measurement as stand-alone mass spectrometers, or as non-mass selective devices providing ion focusing for another mass measurement device. The use of ion traps to perform focusing prior to another mass analyzer is described in US Patent Application Publication No. 2005/0151073 A1 and PCT Application No. WO2005083742 A2. Ion traps have also been used in conjunction with orthogonal Time of Flight (o-TOF) analyzers allowing improvement in transfer efficiency and duty cycle. The development and characterization of ion traps as ion focusing devices is important not only for ion trap mass spectrometry but also to enable them to be coupled with other mass analyzing techniques for enhancing the overall performance of the mass spectrometer.

One common mass spectrometer is the Fourier Transform Ion Cyclotron Resonance (FTICR) Mass spectrometer. The FTICR consists of Fourier Transform analysis of ion trajectories in an ion trap and is the most expensive currently existing mass spectrometry technique. A single instrument typically costs over a million dollars. FTICR has been described by many people including: L. Chen, A. Marshall, Effect of Time-domain Dynamic Range on Stored Waveform Excitation for Fourier Transform Ion Cyclotron Resonance Mass Spectrometry, Rapid Commun. in Mass Spectrom. Vol, No. 3 1987, 39-42, which is hereby incorporated by reference.

An FTICR uses a Penning ion trap as described in F. M. Penning, Physica (Utrecht) 3, 873 (1936), which is hereby incorporated by reference. An explanation of ion confinement in a Penning ion trap is in P. K. Ghosh, Ion Traps, Oxford University Press, 1995, which is hereby incorporated by reference. Furthermore, different Pennning ion traps exist such as those described in G. Ciaramicoli, I. Marzoli, and P. Tombesi, Scalable Quantum Processor with Trapped Electrons, Phys. Rev. Lett. 91, 017901-1 (2003), which is also incorporated by reference.

Many attempts have been made to reduce the cost of this technique and apply it to ion traps which do not require superconducting magnets (as required by the FTICR). To date only one example gives high resolution mass spectra and was patented by A. Makorov (WO9630930, Applicant: HD Technologies limited (GB); (GB), Pub. Date 1996-10-03) which is hereby incorporated by reference. This allowed an instrument called an Orbitrap to be commercialized and an individual instrument costs several hundred thousand dollars. Despite the high price the Orbitrap is still very cheap compared to the FTICR and has sold widely since it was commercialized.

Other recent attempts to perform image current detection (FT analysis) in a 3D ion trap are described in Y. Zerega (Int. Conf. Mass Spectrom. Prague, Czech Republic, 2006) and G. Cooks (E. R. Badman, G. E. Patterson, J. M. Wells, R. E. Santini, R. G. Cooks, Differential non-destructive image current detection in a Fourier transform quadrupole ion trap. Journal of Mass Spectrometry, 1999, 34(8), 889-894), which are hereby incorporated by reference.

Several recent patents have also been filed by international mass spectrometry companies such as "Method and apparatus for Fourier Transform Mass Spectrometry (FTMS) in a linear multipole ion trap" was described by U.S. Pat. No. 6,784,421 B2 filed on 14 Jun. 2001 by M. A. Park patentability as well as GB 2418528 A with a priority data date of Jul. 2, 2004 and was filed on the Jul. 21, 2005 attributed to M. Green, R. H. Bateman and J. Brown describing "Detecting the frequency of ions oscillating along the longitudinal axis of a linear ion guide or trap" by Micromass.

Older attempts to perform FT-ion trap were made by the international company Thermo Finnigan and include the conference presentation: M. W. Senko, J. C. Schwartz, A. E. Schoen, J. E. P. Syka (48th ASMS conference on Mass Spectrometry and Allied Topics, Longbeach, Calif., 2000) and the U.S. Pat. No. 6,403,955 B1 (attributed to M. Senko and filed on 26 Apr. 2000).

S. Ring, H. B. Pederson, O. Heber, M. L. Rappaport, P. D. Witte, K. G. Bhusan, N. Alstein, Y. Rudich, I. Sagi, D. Zajfan, Anal. Chem. 2000, 72, 4041-4046 described image current detection in an electrostatic ion trap.

Although 3D ion traps can focus ion cloud sizes up to approximately 1 mm in diameter, their drawbacks include limitations in ion ejection and use as intermediate devices. Other mass spectrometry devices may include cons such as large size, limited applications, cost-effectiveness, a very large K.E. distribution of the ions on ejection, or other problems (e.g., the desired spatial dispersion, mass/charge measurement precision associated with radial and axial ion detection, electrode fabrication limitations, etc.). An example of the K.E. range that would be produced for a 3D ion trap is described in C. Marinach, A. Brunot, C. Beaugrand, G. Bolbach, J.-C. Tabet, Int. J. Mass Spectrom. 2002; 213:45, which is hereby incorporated by reference.

Accordingly, it is desirable to have an improved linear ion trap that is quick, space-efficient, affordable, and versatile for use with other mass spectrometry applications.

SUMMARY OF THE INVENTION

According to one aspect of the present invention, a mass spectrometer instrument includes a miniature linear ion trap including at least one pair of multipole rods creating a trapping volume and applying an AC field to impose a radial pseudo-potential well on ions emitted from an ion source. The miniature linear ion trap further includes an entrance lens located at one end of the miniature linear ion trap, the entrance lens including a tubular portion extending into the trapping volume and towards the center of the linear ion trap; and an exit lens located at the other end of the miniature linear ion trap, the exit lens including a tubular portion extending into the trapping volume and towards the center of the linear ion trap; wherein the entrance lens and the exit lens both apply DC fields creating an axial potential well in the trapping volume.

Another aspect of the invention provides a mass spectrometer for analyzing ions, including a miniature linear ion trap with multipole rods emitting RF fields to trap ions within a trapping volume; an entrance lens located at one end of the miniature linear ion trap, the entrance lens including a tubular portion extending into the trapping volume and towards the center of the miniature linear ion trap; and an exit lens located at the other end of the miniature linear ion trap, the exit lens including a tubular portion extending into the trapping volume and towards the center of the miniature linear ion trap; wherein the entrance and exit lenses include electrodes to detect the image current of the ions.

In yet another aspect of the invention, a method of analyzing mass in a spectrometer includes providing a miniature linear ion trap including at least one pair of multipole rods arranged for creating a trapping volume; admitting ions through a tubular entrance lens into the trapping volume; applying an AC field to impose a radial pseudo-potential well on ions emitted from an ion source; applying DC fields to the tubular entrance lens and the tubular exit lens to create an axial potential well; and trapping the ions in the axial potential well and the radial pseudo-potential well.

DETAILED DESCRIPTION

Figure 1:
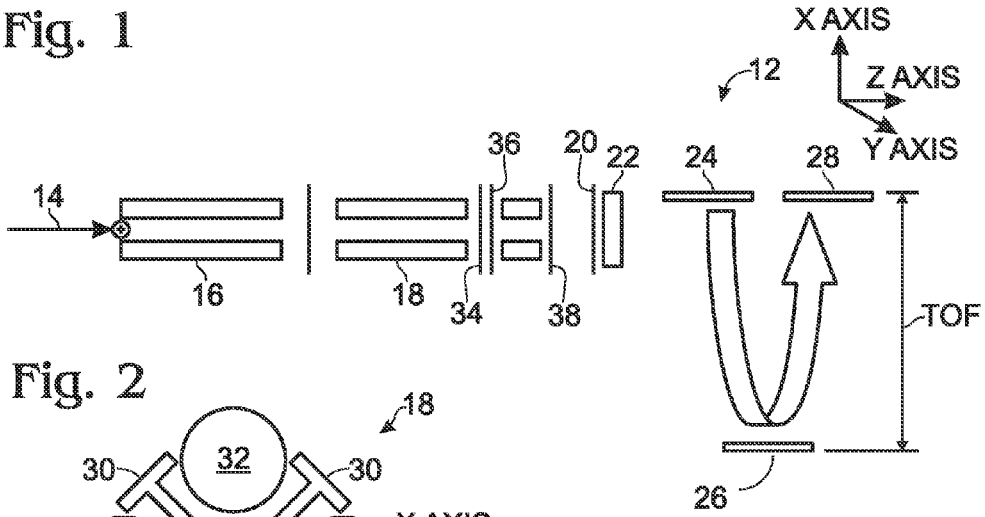
FIG. 1 is a schematic view of a mass spectrometer system in accordance with one embodiment of the present invention.

In one or more embodiments, the present invention provides a miniature linear ion trap (hereinafter referred to as "MLIT") for use in mass analysis. As shown in FIG. 1, according to one embodiment of the present invention, the MLIT is used as an intermediate device 10 within a mass spectrometer system 12. Alternatively, the MLIT may be coupled to another mass spectrometer system or used as a standalone device.

Mass spectrometer system 12 may include an ion source 14, quadrupole 16, axial and radial ion focusing device 18, MLIT 10, grid 20, einzel 22, accelerator 24, mirror 26, and detector 28. For example, an extensively modified Qstar QqTOF (quadrupole, quadrupole, time-of-flight) mass spectrometer available from MDS Sciex may be used. The mass spectrometer system may be configured with other mass spectrometry devices as well.

Ion source 14 may be any source of ions generated from a sample. For convenience and other factors, the sample Angiotensin II (Asp-Arg-Val-Tyr-Ile-His-Pro-Phe) was chosen. The sample can be purchased from Sigma (St. Louis, Mo., U.S.A.) and prepared as a 1 μM solution $CH_3OH:H_2O$ (50:50) with 0.2% acetic acid. To generate ions from the sample, electrospray ionization (ESI), desorption electrospray ionization (DESI), electron impact (EII) matrix-assisted laser desorption/ionization (MALDI), or other ionization techniques may be used. It is understood that combinations of ionization techniques may be used to enhance the information obtained in the resulting mass spectra such as the simultaneous use of ESI and another ionization technique such as EI, in conjunction with the MLIT.

Quadrupole 16 functions as an ion guide or mass filter for ions before they enter ion focusing device 18. Other applicable multipole devices such as an octapole or decapole may be used instead.

Figure 2:
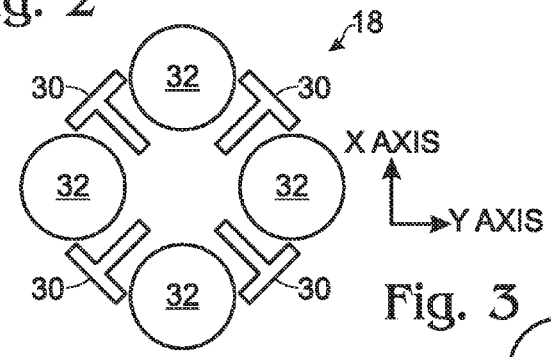
FIG. 2 is an end view of an example of ion focusing device preceding a miniature linear ion trap.

The ion focusing device 18 is used in directing ions in a wide DC potential well in the axial plane and by RF voltages in the radial plane. Referring to FIG. 2, for example, a device such as LINAC™ made by MDS Sciex (Ontario, Canada) is a quadrupole with four T rods 30 (auxiliary rods) inserted between multipole rods 32. The T rods allow the ions to be pushed through the quadrupole with constant acceleration. Two electrodes have been placed between the MLIT and device 18, forming an exit lens 34 to device 18 and an entrance lens 36 to the MLIT. The combination of the exit lens on the ion focusing device 18 and the T rods allows a wide DC potential well to be formed and as a result, the ions accumulate. For purposes of this disclosure, device 18 serves as an ion source for the MLIT.

For following experiments using the LINAC™, a DC voltage of 51V was applied to the T rods with typically a 13.7V DC offset applied to the quadrupole rods, relative to a first element of the einzel lens 22. Nitrogen flow in device 18 was kept constant and was approximately 1.4 mTorr. In device 18, the nitrogen pressure allows collisional ion cooling as well as ion accumulation, as further described below.

In the depicted exemplary embodiment, the ion focusing device 18 was shortened by 3 cm (from circa 20 cm) so that the MLIT 10 could be fitted into the mass spectrometer system. The exit lens 34 for device 18 has a diameter of 34 mm and a hole of 1 mm diameter in the center for ion passage. It will be appreciated however, that other embodiments of device 18 may have any suitable diameter and that the hole in the center may similarly be of any suitable diameter. For example, device 18 may have a diameter selected from the group consisting of i) 0-2 mm; ii) 2-4 mm; iii) 4-6 mm; iv) 6-8 mm v) 8-10 mm; vi) 10-12 mm; vii) 12-14 mm; viii) 14-16 mm ix) 16-18 mm x) 18-20 mm; xi) 20-22 mm; xii) 22-24 mm; xiii) 24-26 mm; xiv) 26-28 mm; xv) 28-30 mm; xvi) 30-32 mm; xvii) 32-34 mm; xviii) 34-36 mm; xix) 36-38 mm; xx) 38-40 mm xxi) 40-45 mm; xxii) 45-50 mm; xxiii) 50-55 mm and a hole selected from the group consisting of i) 0-2 mm; ii) 2-4 mm; iii) 4-6 mm; iv) 6-8 mm v) 8-10 mm; vi) 10-12 mm; vii) 12-14 mm; viii) 14-16 mm ix) 16-18 mm x) 18-20 mm; xi) 20-22 mm; xii) 22-24 mm; xiii) 24-26 mm; xiv) 26-28 mm; xv) 28-30 mm; xvi) 30-32 mm; xvii) 32-34 mm; xviii) 34-36 mm; xix) 36-38 mm; xx) 38-40 mm xxi) 40-45 mm; xxii) 45-50 mm; xxiii) 50-55 mm__

Figure 3:
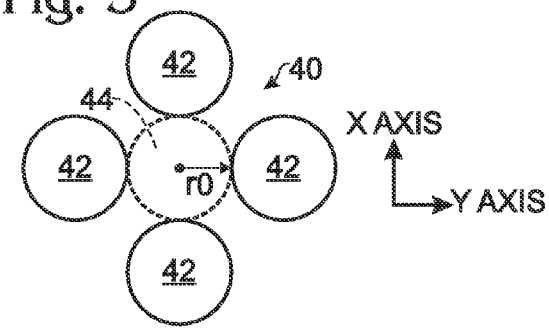
FIG. 3 is an end view of the miniature linear ion trap according to one embodiment.

In the depicted exemplary embodiment, the length of the MLIT as measured from entrance lens 36 to an exit lens 38 is less than 30 mm. However, it will be appreciated that the MLIT may be of any suitable length. As non-limiting examples, the MLIT measurement from entrance lens to exit lens may be selected from the following group i) 0-2 mm; ii) 2-4 mm; iii) 4-6 mm; iv) 6-8 mm v) 8-10 mm; vi) 10-12 mm; vii) 12-14 mm; viii) 14-16 mm ix) 16-18 mm x) 18-20 mm; xi) 20-22 mm; xii) 22-24 mm; xiii) 24-26 mm; xiv) 26-28 mm; xv) 28-30 mm; xvi) 30-32 mm; xvii) 32-34 mm; xviii) 34-36 mm; xix) 36-38 mm; xx) 38-40 mm xxi) 40-45 mm; xxii) 45-50 mm; xxiii) 50-55 mm. In some embodiments, however, it may be considered preferential to use MLIT lengths of less than 30 mm The schematic of FIG. 3 illustrates an exemplary multipole (quadrupole) arrangement 40 within the MLIT creating a trapping volume 44 capable of holding ions. As depicted, rods 42 forming the quadrupole in the MLIT have an inter-electrode spacing between opposite rods ($2r_0$) of 8.4 mm and each rod has a diameter of 9.6 mm. It will be appreciated however, that other suitable inter-electrode spacings and rod diameters may be used. Round cylindrical rods constitute the quadrupole due to easier fabrication. In an alternate embodiment, the rods may be hyperbolic or any other suitable geometry. Further, the MLIT may include an additional number of rods.

In the embodiments shown, the lengths of the rods in the MLIT may be 15 mm and 25 mm depending on the desired application. As an alternative, the rod length may be longer or shorter to achieve optimal and/or required parameters as described. The entrance and exit lenses used in linear ion traps are separated from the multipole rods by a distance sufficient to prevent a short circuit. For example, a space of between 1-2 mm is generally left on either side of the rods between the entrance and exit lenses and the rod ends, which can constitute up to 29% of the total length in the case of MLITs with multipole rods 10-20 mm long. Generally, the distance between both the lenses and the quadrupole rods makes up approximately 20% of the total axial distance.

Returning to FIG. 1, after traveling through the MLIT, the ion encounters a grid 20, which may be spaced dependent upon flight path length. The grid's potential may be selected such that performance is optimized. The ion then moves through the einzel 22. The einzel lens 22 is used to focus ions in flight and may be accomplished through manipulation of fields in the path of ions.

The mass spectrometer system may further include a time-of-flight mass analyzer (TOF) including accelerator 24, mirror 26 and detector 28. Accelerator 24 imposes a push pulse on the ion, sends it to the mirror which reflects the ion to the detector. In turn, mass spectra can be determined from the sample. It should be noted that detector 28 may be a micro-channel plate (MCP) detector or other detector array.

The MLIT may be suitable for use with a distance of flight spectrometer (DOF), as further described below. More information about DOF can be found in U.S. Pat. No. 7,041,968 entitled "Distance of Flight Spectrometer for MS and Simultaneous Scanless MS/MS" to C. Enke, issued May 9, 2006, which is hereby incorporated by reference.

Figure 4:
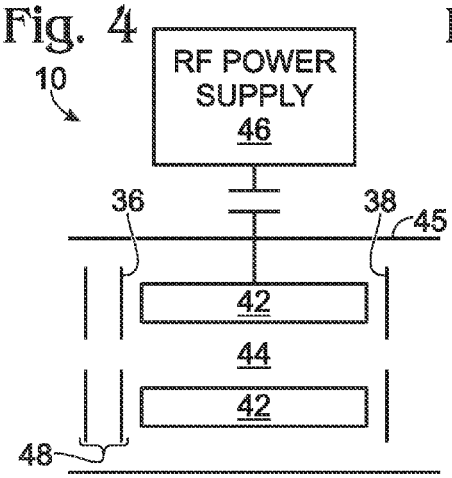
FIG. 4 is a schematic view of a miniature linear ion trap according to one embodiment.

Referring now to FIG. 4, the schematic diagram shows one embodiment of MLIT 10. In some ways similar to the functionality of ion focusing device 18, MLIT 10 includes a housing 45 and an RF power supply 46 to provide RF voltage to quadrupole rods 42. The RF voltage applied to the quadrupole rods in the MLIT is the same as that applied to the quadrupole rods in the ion focusing device 18. Alternatively, depending on what is desired, the RF voltage may vary from the voltage used in the ion focusing device 18. It is also possible to apply Direct Current (DC) voltages to the multipole rods such that the DC voltage is the same or different on all of the rods.

For a radial inter-electrode spacing of $2r_0$ between quadrupole rods 42 placed 180° from each other, the stability of an ion with a given mass/charge value depends on the amplitude and frequency of the RF potential applied to the quadrupole rods. The application of the RF potential allows formation of a pseudo-potential well and ions with a stable trajectory to be trapped in the radial plane.

MLIT 10 further includes an entrance lens 36 where the ions can enter at one end of the MLIT and an exit lens 38 where the ions can exit at the other end of the MLIT. In general, the entrance lens and the exit lens are planar. When another focusing device is placed prior to the MLIT it can be advantageous to include a double lens 48 where different DC voltages could be applied to each lens. Each entrance and exit lens includes a hole in the center through which ions can enter into the MLIT and leave the MLIT. In one embodiment, the hole diameter ranges from 1.0-1.5 mm. The entrance lens and exit lens may also be herein referred to as "lenses", "end caps", "entrance and exit lenses", and "lens caps".

Figure 5:
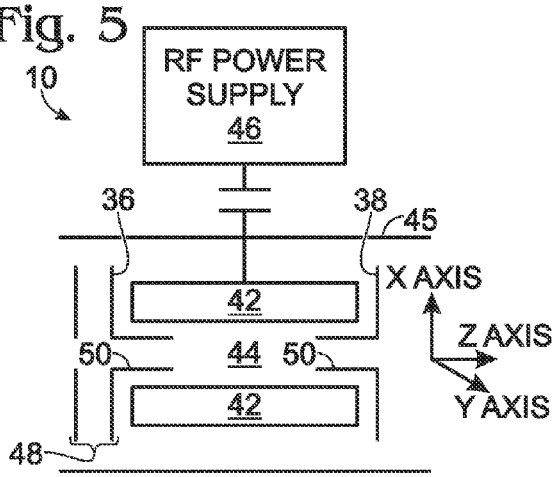
FIG. 5 is a schematic view of a miniature linear ion trap according to another embodiment.

In FIG. 5, in accordance with another embodiment, the MLIT of FIG. 4 further include entrance and exit lenses including tubular portions 50 that extend 5 mm in length oriented towards the center of the MLIT. The tubular portions may be long enough that they extend into the trapping volume created by the quadrupole rods. Tubular portion 50 may be a coaxial tube in the z-direction. Accordingly, when the entrance and exit lenses include a tubular portion, the entrance and exit lenses may be referred to as "tubular lenses".

The tubular lens may be of any suitable length. As non-limiting examples, the tubular lens may be of a length chosen from the following group i) 0-2 mm; ii) 2-4 mm; iii) 4-6 mm; iv) 6-8 mm v) 8-10 mm; vi) 10-12 mm; vii) 12-14 mm; viii) 14-16 mm ix) 16-18 mm x) 18-20 mm; xi) 20-22 mm; xii) 22-24 mm; xiii) 24-26 mm; xiv) 26-28 mm; xv) 28-30 mm; xvi) 30-32 mm; xvii) 32-34 mm; xviii) 34-36 mm; xix) 36-38 mm; xx) 38-40 mm xxi) 40-45 mm; xxii) 45-50 mm; xxiii) 50-55 mm. However, according to some embodiments, it may be more advantageous to change the multipole rod lengths rather than to use tubular lenses longer than 10 mm.

The shape of the tubular portion of the lenses need not be cylindrical, and may have varying geometries that are suitable for the purpose of shielding ions from fields (AC or DC) applied in the vicinity of the MLIT. The tubular lenses can allow transfer of the ions directly from the DC voltage applied to them to the multipole volume. It is worth noting that at a distance following the multipole volume (as present between flat end cap lenses and multipole rods) that the field gradients may vary compared to at the same radial position in the volume occupied by the multipole.

The tubular portion may include slits or sections with missing material or parts consisting of a different material. Further, the lenses do not have to be identical to each other in conductive properties, dimensions, or other properties. Accordingly, the entrance lens may have a first conductive property, dimension, or other property and the exit lens may have a second, different, conductive property, dimension, or other property.

DC voltages may be applied to the entrance and exit lenses (relative to the DC offset voltages applied to the rods) forming an axial potential well within the trapping volume. The axial potential well depth is influenced by the distance between the entrance and exit lenses—the shorter the distance between these two lenses and the greater the applied DC voltage between the lenses and the rods, the steeper the potential well. In identical entrance and exit lenses, DC voltages of equal value would produce an axial potential well centered half the distance between the entrance and exit lenses. Unlike the radial pseudo-potential well, the axial potential well depth is independent of the mass/charge value of the trapped ions.

Figure 6:
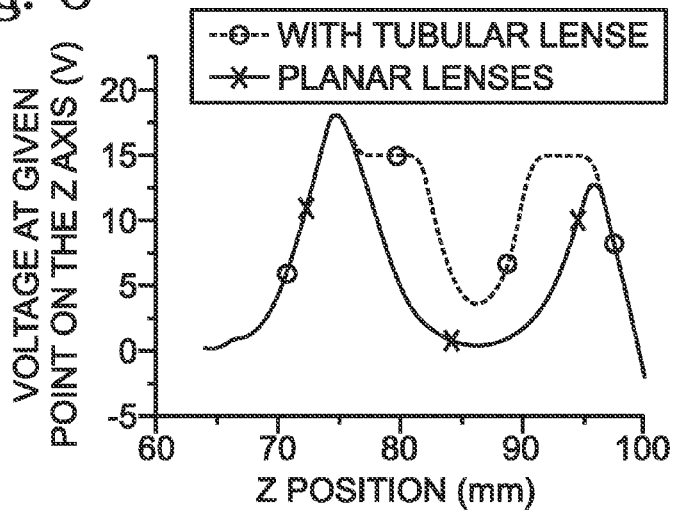
FIG. 6 is an illustration of the axial DC potential well in the miniature linear ion trap, with planar lenses and with tubular lenses.

Referring to FIG. 6, when applying a DC voltage to flat end cap lenses (relative to the grounded first lens of the einzel), an altered DC field may be seen in the vicinity of the hole compared to if the tubular portion was present. When 20V is applied to the ion focusing device 18 exit lens and 15V applied to the flat end cap lenses the DC potential well is asymmetric around the center of the MLIT.

When the flat lenses are replaced by tubular lenses, the DC potential well becomes symmetrical around the MLIT center for the same applied DC voltages. The amplitude of a voltage applied at a given distance from the hole and having penetrated through the hole is a function of: the hole size, the amplitude of the applied voltage, and the distance from the hole at which it is applied. Tubular lenses allow ions to be trapped in a symmetrical potential well uninfluenced by electric fields applied in the vicinity of the MLIT entrance and exit lens holes. However, when potentials are applied in the vicinity of the tubular lens they can penetrate the end of the tube slightly as illustrated by the curves in the voltage in the axial direction at the extremities of the 15V lines at 77 mm and 96 mm.

Figure 7:
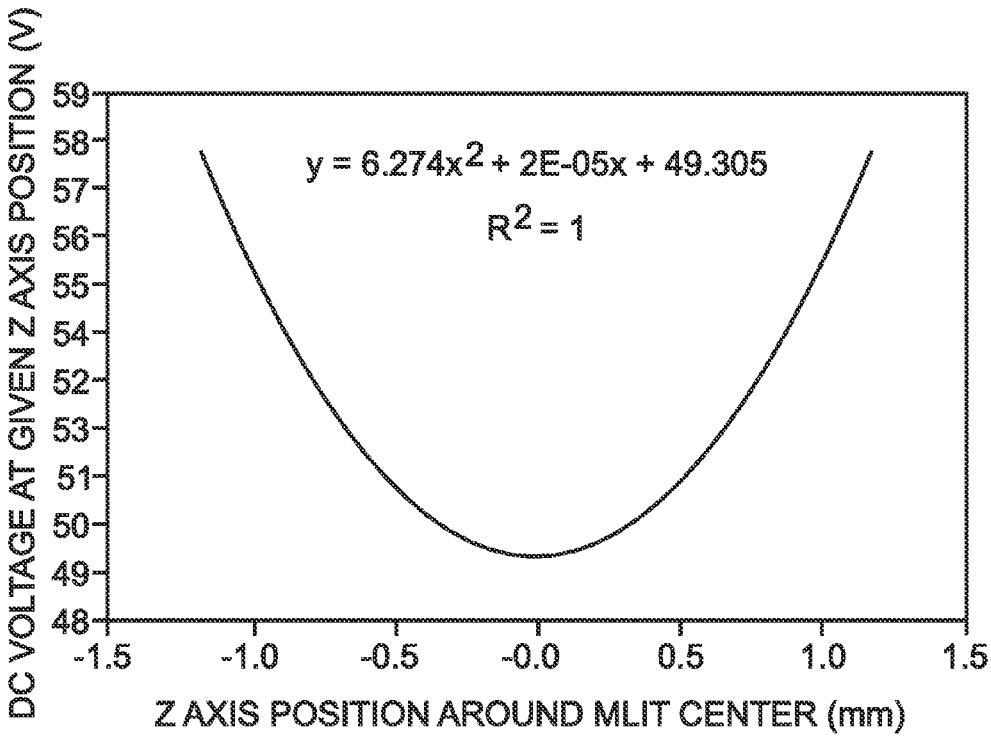
FIG. 7 is a plot of DC voltage at a given z axis position, recentered with respect to the MLIT center.

As shown in the depicted embodiment, whilst the shape of the axial potential well formed by the entrance and exit lenses is symmetrical with respect to the MLIT center, it is not parabolic in form over the entire distance between the end cap lenses. However, the bottom of the potential well is a parabola over approximately 2.5 mm and to a well depth of 9V when focus voltages of 190V are applied to the tubular lenses relative to the zero DC voltage applied to the quadrupole rods (result obtained by simulation with Simion 7.0) illustrated by FIG. 7. The $R^2=1$ indicates a parabola to at least five decimal places. It should be noted that in FIG. 7 the center of the MLIT is recentered on the x axis of the graph, in order to illustrate the relationship between the voltage at each point in the axial direction and the calculated equation: $y=6.274x^2+2E-05x+49.808$. The importance of a parabolic potential well is that it allows the frequency of ion oscillation to be independent of its kinetic energy and is observed here only when the amplitude of oscillation is much smaller than 2.5 mm. This is further discussed below.

Figure 8:
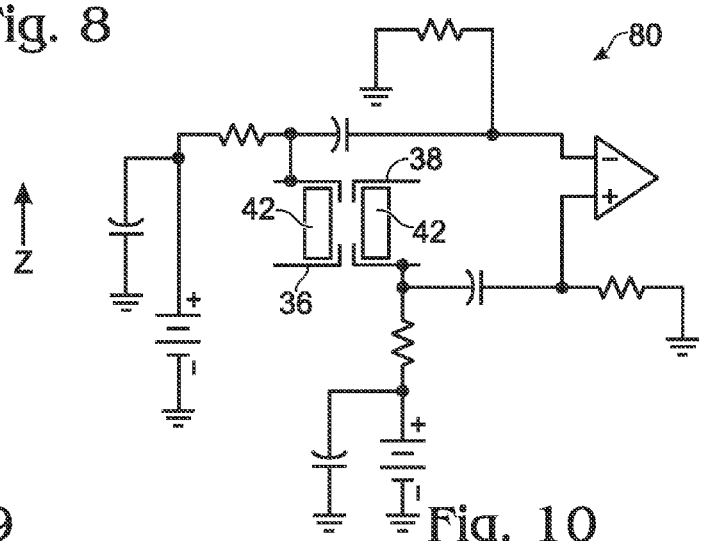
FIG. 8 is a circuit diagram for use in the miniature linear ion trap to allow image current detection.
Figure 9:
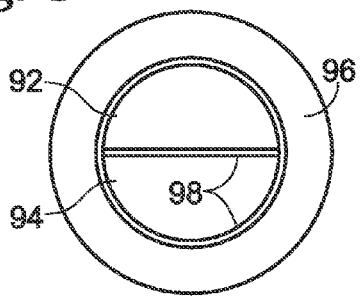
FIGS. 9-10 show end views of embodiments of an end cap with electrodes.
Figure 10:
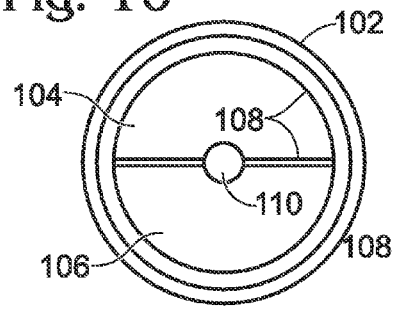

Turning to FIG. 8, in one embodiment, MLIT 10 includes a circuit 80 that may be used to detect image current for spectral analysis. Other circuit configurations may be used to capture data from segmented tubular lenses (as shown in end views in FIGS. 9-10, not drawn to scale). In FIG. 9, an end cap 90 includes a top image current detection electrode 92, a bottom image current detection electrode 94, and an electrode for supplying voltage 96. The electrodes are separated from each other via an insulator 98. According to another embodiment as shown in FIG. 10, an end cap 100 includes a thin voltage supplying electrode 102, a top detection electrode 104, a bottom detection electrode 106, an insulator 108, and an axial hole for ion entry or exit. In these tubular end caps, the detection electrodes detect lower RF fields. It is noted that the quadrupole field is approximately zero volts along the center of the MLIT.

Radial ion detection may be undertaken near the entrance and exit lenses by the use of the end caps allowing a large surface area for picking up ion packet oscillations in the axial and radial directions. The detecting surface area is located in proximity to the ion packet due to the tubular geometry. For example, in an MLIT with 15 mm quadrupoles, the tubular end caps each extend into the trapping volume by 3 mm resulting in a separation of approximately 4.5 mm from the ion packet at the center of the MLIT. Further, since the axial potential well is parabolic over 2.5 mm to circa 5 decimal places in the center of the MLIT, ion oscillation may be detected within 3.25 mm from the tubular lenses. Distance from the ion packet may be decreased by the use of longer tubular lenses or shorter multipole rod lengths. Further, the use of grids as entrance or exit lenses, or covering the holes (that allow ions to enter or to leave the MLIT) can improve field homogeneity. Image current detection will be discussed further below.

Figure 11:
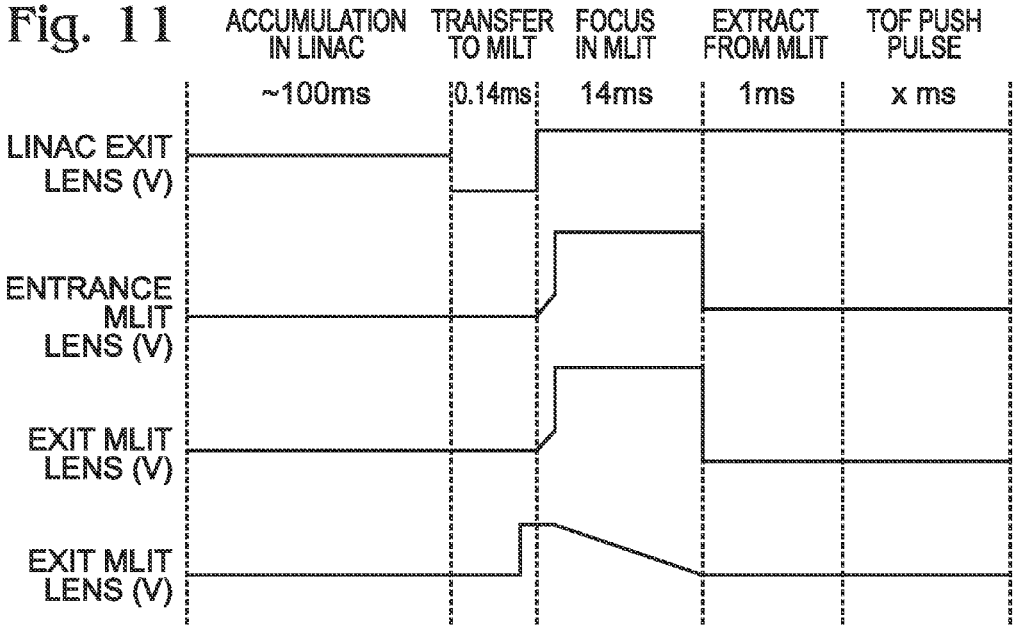
FIG. 11 is a timing diagram of experimental parameters in the mass spectrometer system of FIG. 1.

Turning to FIG. 11, a timing diagram detailing the application and timing of applied DC voltages is provided according to one embodiment. In this example, the timing of the QqTOF is controlled using a house written Labview program (National Instruments, Austin, Tex., U.S.A.) and National Instruments PXI chassis with DAQ and timer modules. In particular, this program controls the DC voltages applied to the ion focusing device 18 exit lens, MLIT entrance lens and MLIT exit lens. Three amplifiers purchased and assembled from Apex Microtechnology components (Tucson, Ariz., U.S.A.) allow fast response amplification of the time controlled Labview signals up to 190V. The timing of the valve controlling the helium pulse is also controlled by the program. All other voltages were accessible through the Analyst software (MDS Sciex) available on the QqTOF.

As previously described, the ions accumulate in the ion focusing device 18 and then transfer to the MLIT where device 18 exit lens voltage decreases from 20V to 12V. Following the decrease in the device 18 exit lens voltage, 20V is applied for the rest of the analytical scan. The entrance lens voltage is 1.5V less (10.5V) than the device 18 exit lens voltage during the transfer of the ions and half a volt higher than the DC offset applied to the quadrupole rods in the MLIT. During the transfer of the ions to the MLIT, the exit lens voltage is kept at 17V to prevent ions from passing through the MLIT. The transfer to the MLIT requires more than 0.035 ms in order to allow constant intensity mass spectra to be obtained. The intensity of ions in the resulting mass spectra was observed to be time dependent for transfer times less than 0.035 ms.

Following a long transfer time of 0.14 ms, the focus voltage or "focus" (voltage applied to entrance and exit lenses) increases linearly. In order to limit the increase in the ion velocities which can occur with a differing ramp in the entrance and exit lens voltages, the exit lens voltage drops for 0.002 ms from 17V to 15V. The focus consists of a first linear ramp in the entrance and exit lens voltages from 15V to 30V over 0.04 ms followed by a second slower ramp from 30V to 50V over 2 ms. The focus applied to the entrance and exit lens is then immediately increases to the value used for the rest of the focus time (with a maximum of 190V). It should be noted that a DC offset voltage of 10V is applied to the multipole rods of the MLIT during the transfer, focus and ejection of ions (unless otherwise stated) although other voltages are possible. Therefore, according to some embodiments, in order to obtain the voltages of the lenses with respect to the rods, 9V should be subtracted from the voltages given.

The extraction of the ions from the MLIT and their passage through the grid occurs over times much shorter than the times used in this part of the timing diagram (1 ms). The orthogonal-TOF (o-TOF) push pulse (13 μs) consists of a non-modified voltage applied to the accelerator in the TOF section and is scanned in time following the beginning of extraction from the MLIT. In other words, the time of application of this DC o-TOF push voltage required to accelerate the ions through the TOF section is changed linearly in time with the beginning of the extraction from the MLIT (corresponding to a TOF push pulse time of Oms). This allows us to measure ion packet arrival times at this TOF push pulse region as well as the time of flight in the TOF section in the vertical plane (conventional TOF).

Ion loss may occur during the transfer of the ions from the ion focusing device 18 to the MLIT. The helium gas comes from an ultra high purity helium bottle (Trigas, Irving, Tex., U.S.A.) with a fine regulation valve (BOC Edwards, Crawley, West Sussex, U.K.). Following the fine regulation valve, a two stage 1.5 pump (BOC Edwards, Crawley, West Sussex, U.K.) has been introduced to decrease the gas pressure. Between this reduced pressure region and the MLIT, a valve (Iota, General Valve Corporation, Fairfield, N.J., U.S.A.) controls a DC trigger pulse sent by the program allowing approximately 100 ms between the gas pulses which is used for ion accumulation in device 18. During ion transfer to the MLIT, through the entrance lens, the program increases the helium pressure in the tubular lenses and the MLIT. The tubular lenses were designed so that both helium gas and the ions which have accumulated in device 18 are transferred together into the MLIT. The aim of the tubular lens in this role is to obtain a higher mean collision frequency between the gas and the ions allowing for low kinetic energy ion introduction into the MLIT. The low kinetic energies of the ions obtained through collisional cooling, as well as the depth of both the axial potential well and the radial pseudo-potential well, will define the spatial packet width of the ions for different mass/charge values in the MLIT.

Figure 12:
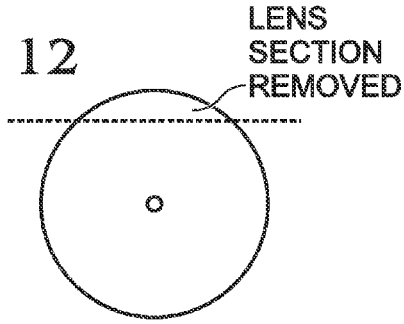
FIG. 12 is a schematic end view of one embodiment of an entrance lens.

The helium pressure decreases after the 3 ms pulse throughout the rest of the focus so that it is at a minimum during the extraction of the ions from the MLIT. The helium gas pulse is applied 0.5 ms before the focus of the ions in the MLIT for a duration of 3 ms. After focus in the MLIT, the helium gas can escape through the holes in the housing surrounding the MLIT. In one embodiment as shown in FIG. 12, the entrance lens to the MLIT has 2 mm cut from the outside edge of the lens. The removal of part of this outside edge allows a faster decrease in the helium pressure when a helium gas pulse is stopped. With this in mind, the lens may be designed to exhaust gas, for example, by incorporating the exhaust holes described above or by including some other suitable mechanism. For example, other exhaust mechanisms may include switching the connection from the tube supplying the gas allowing collisional cooling to another connection at a lower pressure via electrical and mechanical connections.

Figure 13:
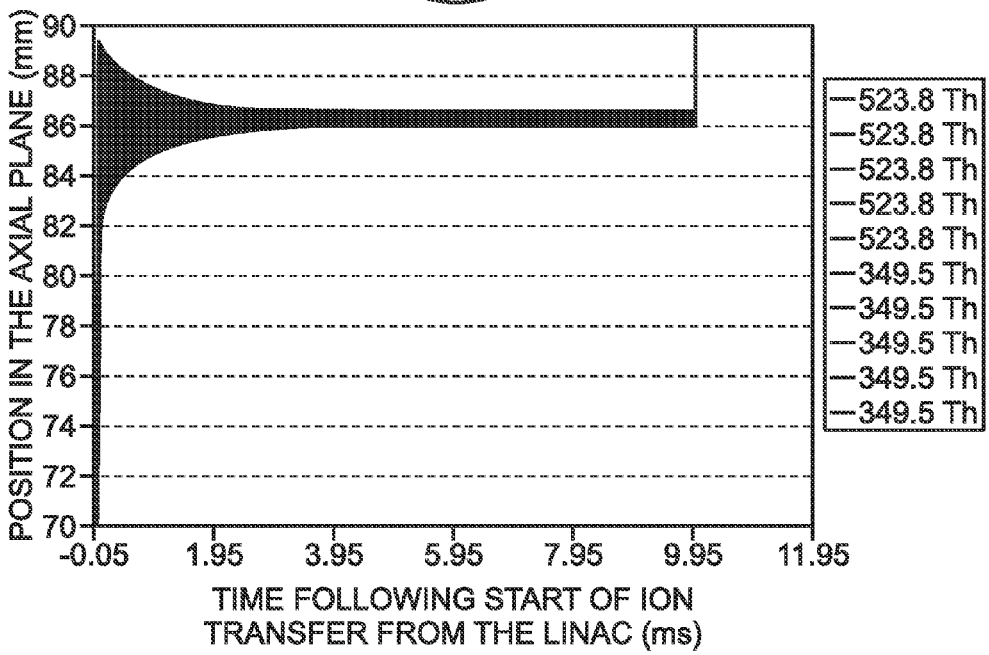
FIG. 13 is a plot of the trajectories of ions of 349.5Th and 523.8Th after transfer to the miniature linear ion trap.

For MLIT ion focusing simulation, a hard sphere collision cooling model and developed user programs for Simion 7.0 were used to create FIG. 13. Ions enter into the MLIT (Oms) with kinetic energy of approximately 3 eV from the ion focusing device 18, which has allowed ion accumulation near the device 18 exit lens. The entrance lens is at 76.8 mm and the center of the ion trap is at 86.3 mm. During the transfer into the MLIT a DC voltage of 15V was applied to the exit lens (95.8 mm) preventing ions from simply passing through the MLIT. Upon entrance into the MLIT, the ions were confined in a DC potential well formed by application of 110V to the tubular end caps and 9V DC offset to the quadrupole rods. Focusing was carried out here during 10 ms for a helium pressure (constant throughout the 10 ms) between 30-40 mTorr. The ions oscillate with a trajectory of circa 4 mm around the MLIT center. Collisions with the helium buffer gas gradually allow a reduction of the 10 ions' kinetic energy allowing oscillation with increasingly smaller trajectories around the MLIT center. However, despite the use of a 10 ms focusing time, little change is observed in the spatial focusing after 4 ms and the ion packet width remains less than 1 mm in the axial direction. After 10 ms the different mass/charge ions oscillate with a trajectory with similar axial and radial dimensions and possess diameters of 0.5 mm in the axial plane (around the center of the MLIT at 86.3 mm) and 0.8 mm in the radial plane. Following the focus of the ions to the center of the MLIT, it was possible to undertake batch ion extraction with 20V applied to the MLIT tubular entrance end cap lens, 5V applied to the exit end cap lens and a 10V DC offset applied to the quadrupole rods.

Whilst this simulation demonstrates that good axial focusing (comparable to 3D ion traps) is possible in an MLIT with tubular end cap lenses, it also suggests that much of the decrease in the spatial distribution can occur during a short helium pulse (3 ms) as used above.

The spatial distribution of ions is affected by the width of the potential wells and cooling in the MLIT. Ions in the trapping volume will be cooled by collision with the buffer gas (helium, nitrogen, others, or mixtures of gases) to the bottom of the potential wells. The chemical nature and pressure of the gas will affect the rate of cooling of the ions. When the ions are cooled in the MLIT to near thermal kinetic energy, the resulting spatial distribution will depend on the potential well width for that energy. For example, if a wide axial potential well is formed using low DC voltages applied to the entrance and exit lenses, the ions would occupy a larger spatial distribution than in a narrower potential well formed by higher DC voltages.

The spatial distribution of ions in the MLIT prior to batch ion extraction will result in a spatial and temporal packet width at the o-TOF push pulse for each mass/charge ion packet. The ion intensity can be plotted as a function of the time of the o-TOF push pulse following the batch ion extraction from the MLIT. Different mass/charge values can be identified by their time of arrival at the TOF push pulse region due to their mass/charge dependent velocities. However as the o-TOF push pulse is only circa 5 cm from the exit lens, considerable overlap between the different mass/charge ion packets can occur. The individual mass/charge ion intensity data is therefore obtained by selecting it from the total ion current (TIC) (called XIC in Analyst, MDS Sciex). When the intensity is plotted against the o-TOF push pulse time (μs) following the start of the batch ion extraction the full width at half maximum (FWHM) (μs) is calculated from the resulting peak, for each mass/charge value. The focus voltage applied prior to batch ion ejection influences this temporal packet width—FWHM (μs), at the o-TOF push pulse.

Figure 14:
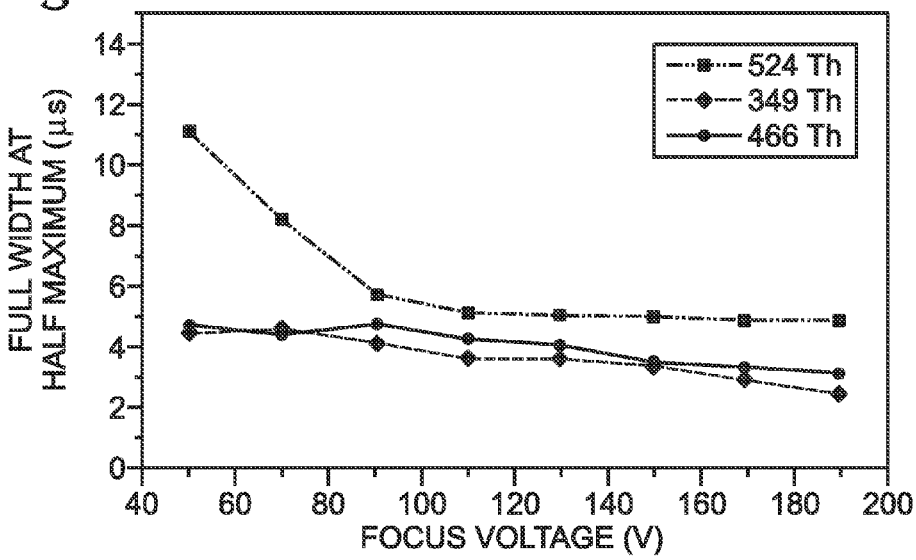
FIG. 14 is a plot showing the temporal spread at the orthogonal-TOF push pulse as a function of applied voltage.

FIG. 14 indicates that an increase in the focus voltage applied to the entrance and exit lenses decreases the temporal spread globally at the o-TOF push pulse (and therefore the spatial distribution) for ions of different mass/charge values (350Th $[M+3H]^{3+}$, 466Th $[\{Arg\text{-}Val\text{-}Tyr\text{-}Ile\text{-}His\text{-}Pro\text{-}Phe\}+2H]^{2+}$ and 524Th $[M+2H]^{2+}$). Increasing the DC focus voltage applied to the tubular lenses from 50V to 190V was observed to decrease the FWHM from 4.5 μs to 2.5 μs at the TOF push pulse for the 350Th ion packet. The same increase in the DC voltage to the tubular lenses allowed a decrease in the temporal distribution of the 466Th ion packet at the TOF push pulse from 4.7 μs to 3.1 μs and for the 524Th ion packet from 11.1 μs to 4.8 μs. Whilst the temporal FWHMs of the different mass/charge ion packets are decreased to half their initial times by increasing the focus voltage applied to the tubular lenses from 50V to 190V, the temporal FWHM of 4.8 μs for the 524Th ion packet remains much larger after 14 ms focusing than that of the 350Th ion packet (2.5 μs).

Extraction

Figure 15A:
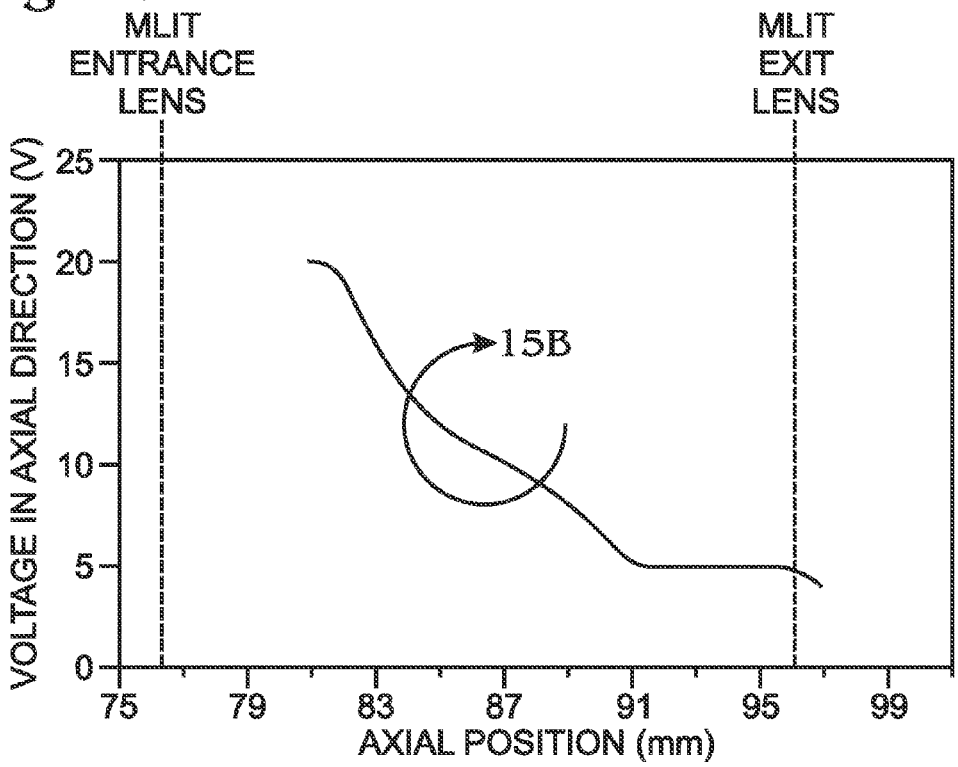
FIGS. 15*a-b* are plots showing a low DC voltage gradient as a function of axial potential.
Figure 15B:
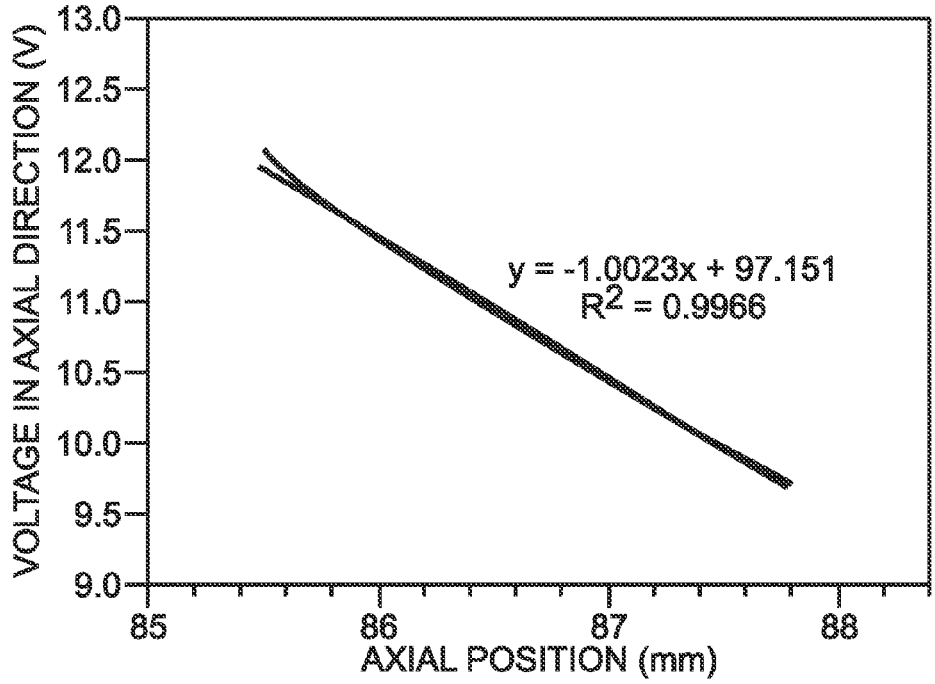

For low kinetic energy batch ion extraction (also "ejection") from the MLIT, low DC voltage gradients are applied to the tubular end caps during ion ejection. If 20V is applied to the entrance lens and 5V to the exit lens with a 10V DC offset to the MLIT quadrupole rods, a voltage gradient of 1V/mm is obtained across the center of the MLIT (FIG. 15). Assuming cooling to near thermal kinetic energy, the kinetic energy distribution of the ions on ejection from the MLIT will therefore be principally due to the spatial distribution of the ion packet prior to ejection. Also, the cooling of the ions in the MLIT will influence the kinetic energy distributions on batch ion extraction by the size of the initial ion packet in the axial direction.

Ions are typically ejected with kinetic energies of approximately 10 eV so that they can be detected on a detector following a time of flight. It would be appropriate to use stainless steel tubular lenses, which are conductive to both AC and DC fields. It is possible to create the tubular lenses using a dielectric material such that it remains conductive to DC fields but non-conductive to AC fields. In the case of very low kinetic energy ejection from the MLIT this could be useful for improving the radial focusing should the time spent by the ion on extraction be several orders less than the time of oscillation of the RF voltage applied to the quadrupole rods.

Figure 16:
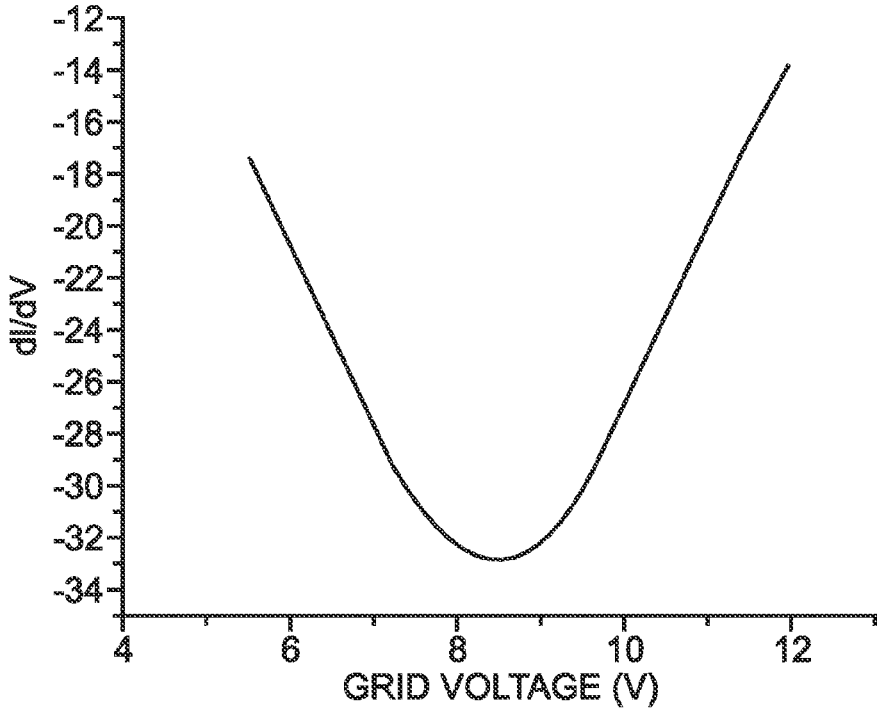
FIG. 16 shows the kinetic energy distribution of the ions at 1 ms focus time with 110V applied to the entrance and exit lenses, helium being pulsed into the MLIT for 0.75 ms.
Figure 17:
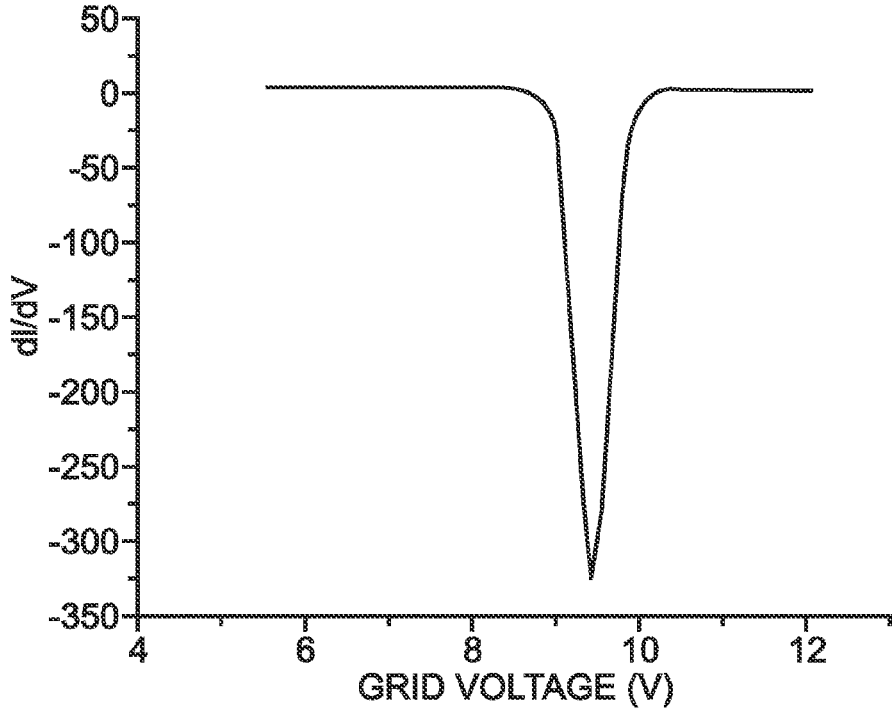
FIG. 17 shows the kinetic energy distribution of the ions at 14 ms focus time with helium being pulsed into the MLIT for 2.5 ms.

The kinetic energy distributions of ion packets are affected significantly by cooling. When a retarding DC voltage applied to the grid following the exit lens is varied, ions with a kinetic energy less than the grid voltage cannot be observed. The derivative of the variation in intensity with the grid voltage illustrates the kinetic energy distribution of the ions. In FIG. 16, a 1 ms focus time with 110V applied to the entrance and exit lenses was used with helium being pulsed into the MLIT for the first 0.75 ms. A kinetic energy distribution of approximately five volts resulted from the 1 ms focus. By contrast, in FIG. 17, when a typical 14 ms focus was used with helium being pulsed into the MLIT for 2.5 ms, a narrow kinetic energy distribution was observed (circa one volt). The one volt kinetic energy distribution can be attributed to the spatial distribution of the ions prior to ejection, thus demonstrating focusing to approximately 1 mm total axial dispersion.

The use of focus voltages greater than 150V applied during collisional cooling of the ion packets gives rise to loss of high mass/charge ions. High DC voltages should therefore be used with an MLIT with tubular lenses to allow ion focusing by collisional cooling in a narrow potential well, but they should be sufficiently low not to limit the overall mass/charge range.

Inducing Ion Oscillation

In one embodiment of using tubular lenses in an MLIT, there are different ways of inducing an oscillation of ions in the axial potential well for changing spatial dispersion. Suitable voltages applied to the entrance and/or exit lenses can allow ions to oscillate allowing them to remain as much as possible in the parabolic region of the axial potential well. The voltage is proportional to the square of the distance from a point of origin while obtaining a frequency of oscillation allowing a spatial dispersion to occur within a desired period of time. The nature of the axial potential well will affect the oscillation frequency of the ions by its depth and also by the position of the potential well minimum with respect to the geometric center of the MLIT.

A single pulse may be applied to either the entrance lens or exit lens to increase the oscillation amplitude of an ion in a chosen axial potential well. The initial pulse may cause all the ions to move in the same axial direction. This motion can convert bidirectional energy dispersion into a spatial dispersion of ions moving in the same direction.

A double pulse may be applied such that the amplitude of the pulse applied to the entrance lens is greater or lower then that applied to the exit lens and then the voltage differences due to the pulse are inversed.

An alternating pulse may be applied to the entrance and exit lenses in order to excite the ions in the axial potential well. The frequency of the applied alternating pulse will influence the oscillation of the ions in the MLIT. The alternating pulse may be introduced using different excitation methods. It should be noted that any excitation pulses may be square, triangular, sinusoidal or other form.

If an appropriate frequency or frequencies of the applied alternating pulse allow resonance of ions of a single mass/charge value (or ions of several selected mass/charge values) this will cause an increase in their trajectory with respect to the ions of other mass/charge values. This resonant excitation mode will allow ions of different mass/charge values to obtain very different spatial distributions. The resonant excitation of the ions by an alternating pulse can be used to create a spatial dispersion between ions of different mass/charge values as well as eject them according to their mass/charge value towards a detector or another analyzer such as a TOF. If the ions are given a different spatial dispersion in the MLIT and are not ejected during the resonant excitation, they can be ejected by a DC field gradient of suitable magnitude applied between the entrance lens and the exit lens. Ejection of ions using a DC field gradient can allow unidirectional ejection of the ions which is difficult to obtain by resonant ejection. If ions of different oscillation frequencies in the DC potential well due to their different mass/charge values, or due to frequency dispersion resulting from different initial kinetic energies before collisional focusing, are to be given larger trajectories in the MLIT then a frequency sweep such as a stored waveform inverse Fourier transform (SWIFT) pulse can be used. The application of multiple frequencies or a single frequency as a pulse in the MLIT may allow a rapid excitation of the ions.

The use of non-resonant excitation using an alternating pulse of the ions in an MLIT may allow a controlled oscillation of ions of different mass/charge values. The frequency and amplitude of the pulse will influence the frequency and trajectory of the ion in an axial potential well of a given DC voltage depth.

It is also possible to apply a supplementary AC voltage such that resonant ejection from the MLIT occurs for a single mass/charge value or a range of mass/charge values in both the axial plane and the radial plane.

Figure 18:
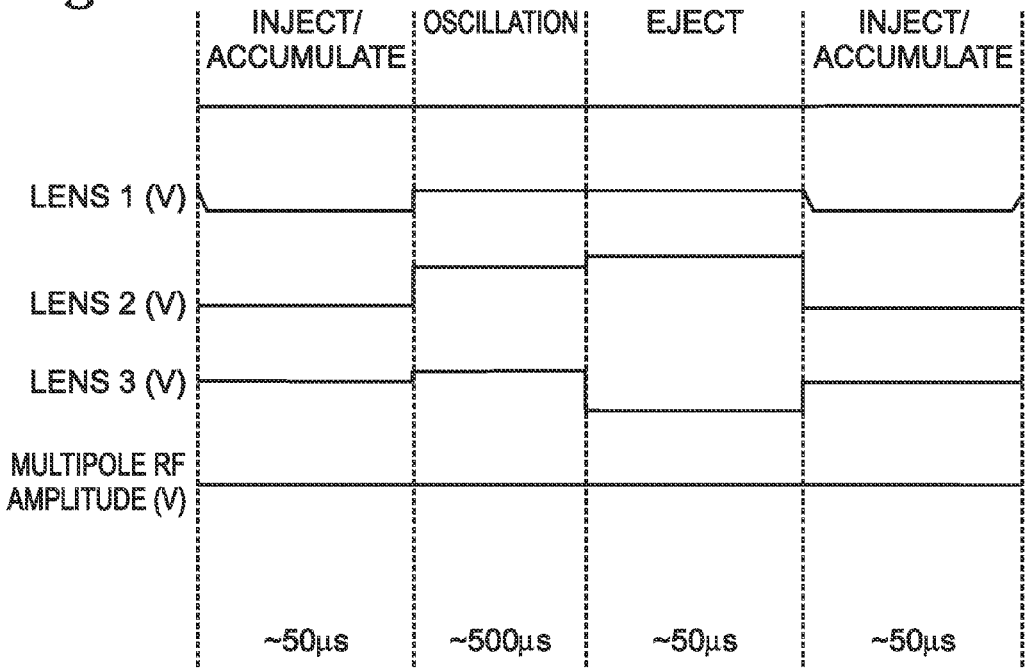
FIG. 18 depicts a timing diagram for the application of the different applied voltages to the lenses to induce oscillation in an axial potential well.
Figure 19:
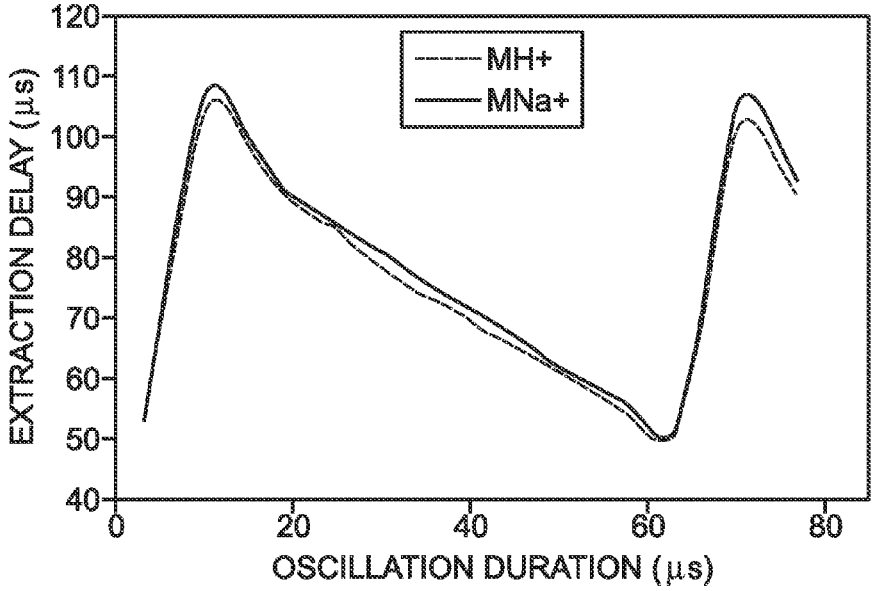
FIGS. 19-20 are plots indicating influence of oscillation duration on extraction delay time.
Figure 20:
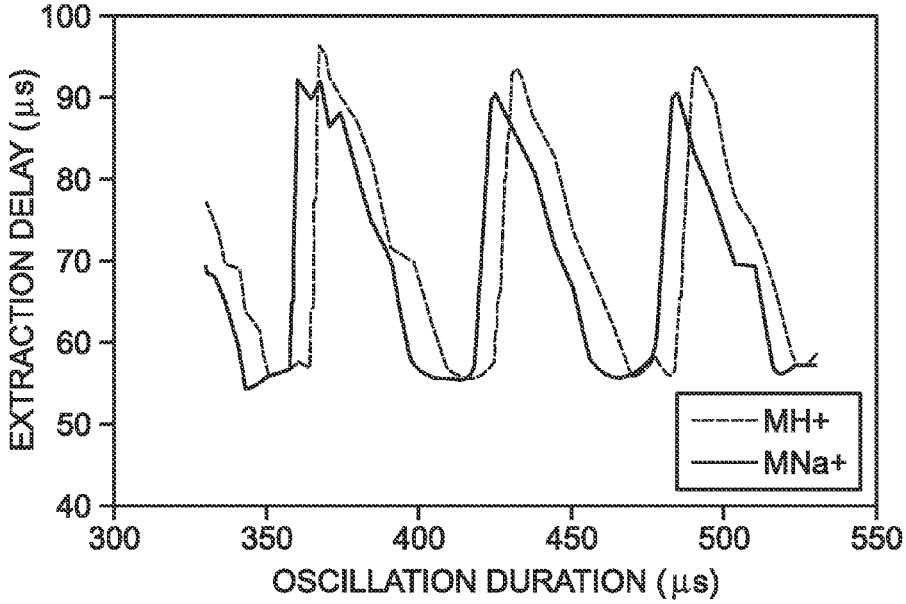

The desired spatial dispersion of the ions of different mass/charge values may be obtained using a potential well without an excitation pulse. In this method, ions are not cooled but are allowed to oscillate in the axial potential well. The oscillation frequency of the ions will be dependent on their mass/charge value. When ions enter into a DC potential well, they will oscillate in the potential well with a mass/charge dependent frequency. If the potential well is not parabolic then ions with different kinetic energies for the same mass/charge value will oscillate with different frequencies. Despite this, even in non-parabolic potential wells, the frequency of the different mass/charge ions will be greater in most cases than the kinetic energy frequency dispersion of the ions. FIG. 18 depicts a typical timing diagram for the application of the different applied voltages to the different lenses and multipole rods to induce ion oscillation in an axial potential well and in an MLIT, following ejection from another ion focusing device. Oscillations at a time of flight MCP detector are illustrated in FIGS. 19-20 for $[M+H]^+$ and $[M+Na]^+$ of taxol. Ion injection into the MLIT occurs from the prior ion focusing device. The oscillation duration corresponds to the time allowing oscillation prior to ejection and is plotted against the extraction duration which illustrates the time of arrival at an o-TOF push pulse. Changing the axial potential well by using longer MLITs such as the one used here with 25 mm long quadrupole rods (instead of, for example, the 15 mm long quadrupole rods) with 2 mm separation between them and the entrance lens (or exit lens), allows lower oscillation frequencies, for given DC voltages applied to the tubular lenses and multpole rods. It should be noted that the different mass/charge dependent frequencies in the axial plane allows the $[M+H]^+$ and $[M+Na]^+$ ion packets to have substantially different spatial distributions in the MLIT depending on the oscillation duration as illustrated by the similar spatial distributions of the two ion packets between 0-80 μs (FIG. 19) and the larger spatial distribution possible during each cycle, observed after an oscillation duration between 350-500 μs.

Figure 21:
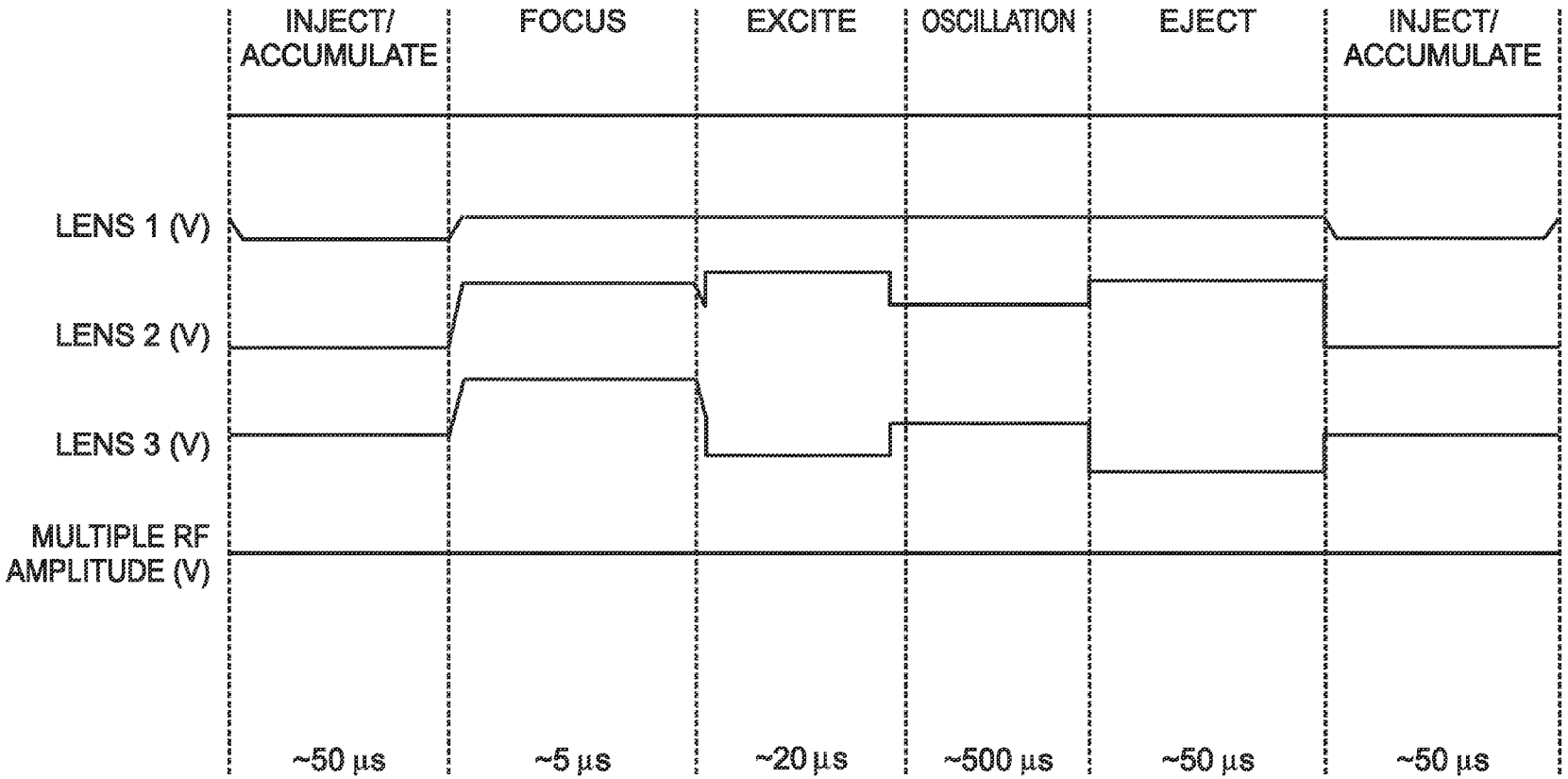
FIG. 21 depicts a timing diagram for a forced ion oscillation mode inducing a spatial distribution for ions of known mass/charge difference.

Another method of obtaining a sufficient spatial dispersion of the ions is to cool the ions and then excite them using an appropriate pulse. The ions may then oscillate in the axial potential well with their characteristic mass/charge related frequencies. The frequency of the ions can be proportional to the square root of their mass/charge value. As the frequency of the ions differs according to their mass/charge value, an appropriate period of time can be chosen for the application of a high field gradient between the entrance lens and the exit lens allowing ejection of the ions from the MLIT. An appropriate time could be, for example, when ions of different mass/charge values have the largest possible spatial distribution in the MLIT (for two ions this would correspond to a 180° difference in their oscillation and for three ions to a 120° difference). FIG. 21 depicts a timing diagram for a forced ion oscillation mode inducing a calculable spatial distribution for ions of known mass/charge difference. It should be noted that the times are varied as a function of the desired spectral properties.

Space charge results when a large number of ions occupy a small volume, e.g., in an MLIT where the ions are cooled to the center and gives rise to a loss in mass/charge measurement accuracy. When ions of different mass/charge values are present it is possible to oscillate the ions over a large distance (several mm) such that space charge is reduced in the MLIT. It should be noted that a kinetic energy change due to space charge in a previous focusing device will not be improved by the oscillation of the ions in the MLIT should no initial focusing be performed in the MLIT.

Resonant ejection of the ions from the MLIT occurs when an AC voltage with the same frequency as the axial frequency of the ions is applied to the end cap electrodes, while the ions are oscillating in the DC potential well. A DC voltage gradient between the entrance and exit lenses can be used but the magnitude of this gradient will influence the direction of the ions ejected from the ion trap.

A DC voltage gradient applied between the entrance lens and the exit lens can be used to eject the ions from the MLIT. The value of the gradient will affect the turn around time of the ions in the MLIT despite the preference of applying these DC voltages when the ions of the same mass/charge value are all going in the same axial direction. It should be noted that the values of the applied DC voltages to the multipole and the tubular lenses will influence the position of the space focus plane (and temporal focus plane) for an ion of a given mass/charge value. Dynamic and static voltages can be used during ejection changing the spatial resolution of a packet of ions.

Figure 22:
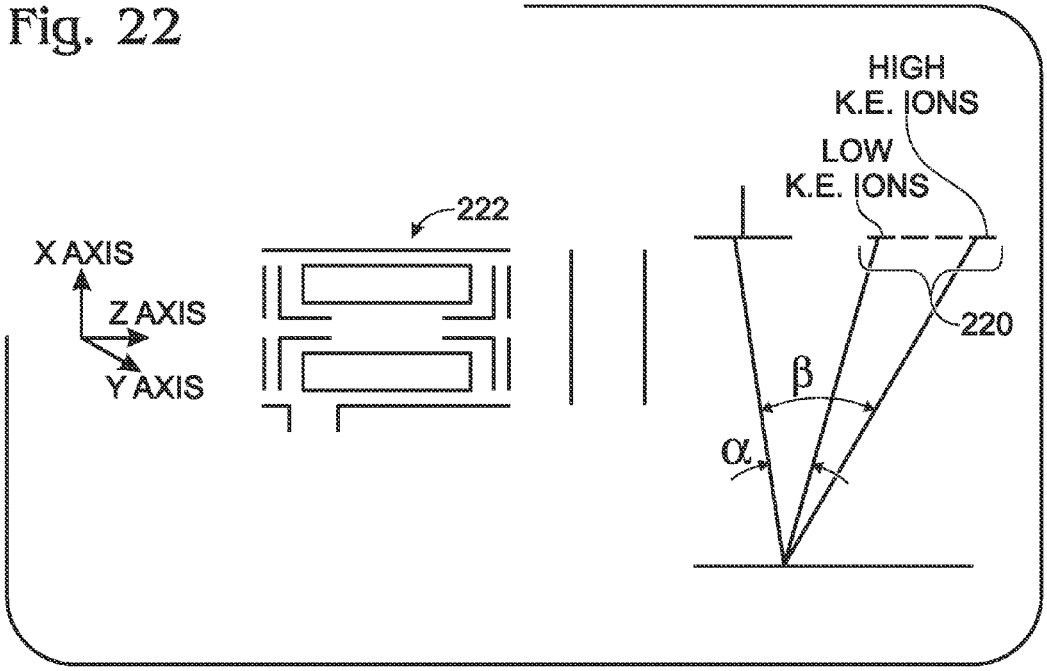
FIG. 22 is a schematic of a miniature linear ion trap coupled to a TOF spectrometer, where ions with higher kinetic energy possess a larger angle.

In FIG. 22, an embodiment using a mass spectrometer capable of resolving the different mass/charge ions according to their kinetic energies in the axial plane with multiple array detector 220 after an MLIT 222 is shown. Helium is pulsed into the MLIT 500 μs before the focus through the tubular lenses for a duration of 2.5 ms. The introduction of ions from an axial and radial ion focusing device with a quadrupole offset of 13.7V and a device exit lens voltage of 11V with a 10V MLIT entrance lens voltage, allows ions to enter the MLIT through a double lens and through the gas flow in a tubular lens. Following the transfer of the ions into the MLIT, a 110V DC voltage is applied to the entrance and exit lenses forming an axial potential well. Ejection of the ions is undertaken by the application of a DC voltage gradient across the MLIT.

The ions of different mass/charge values are ejected by pulsed extraction from the MLIT towards the push pulse associated with the TOF. Lighter ions will have a higher velocity for a given kinetic energy than heavier ions meaning that the lighter ions will be pushed first towards the detectors through the TOF section. Each particular mass/charge value can be considered as an individual ion packet comprised of kinetic energy dispersion. Ions of higher kinetic energy when flying through the TOF will possess a larger angle (illustrated by angle β) than lower kinetic energy ions (illustrated by angle α). It should be noted that the ions that hit detector 4 can only be high kinetic energy ions and ions that hit detector 1 can only be low kinetic energy ions. An exception would be in the case that the fields formed by the electrodes in the accelerator region of the TOF section allowed a non linear acceleration in the axial and vertical planes resulting in a change of trajectories in the axial plane. Ion separation in the TOF section and the observation of ions of different mass/charge values on separate detectors is possible through giving each mass/charge value a different kinetic energy as is possible, for example, through the induced oscillation of the ions in the axial plane prior to batch ion extraction from the MLIT.

When the ions obtain an appropriate spatial distribution the ions can be ejected by application of a field gradient between the entrance lens and the exit lens. The position of the ions in the MLIT when the extract part of the cycle occurs will influence the kinetic energy of the ions. Typical extraction voltages, such as shown in FIG. 15, are applied which consist of 20V on the entrance lens and 5V on the exit lens. It should be noted that tubular lenses have been used in this example and that an ion cloud which has been focused to 0.1 mm will be ejected from the MLIT with 0.1V difference in kinetic energy due to the circa 1V/mm in the center of the MLIT (assuming that the MLIT extraction voltages alone influence the ions clouds kinetic energy on ejection and ignoring kinetic energy variations due to, for example, collisions with the buffer gas).

The ability to perform $MS^n$ using ion traps (in particular with 3D ion traps such as the Paul trap) represents one of the most important mass spectrometry techniques for molecular structural elucidation. $MS^n$ is usually performed by isolation of a single mass/charge value followed by causing them to fragment by various methods and analysis of the resulting fragment ions. $MS^n$ can be performed using an MLIT using the various described fragmentation techniques including, but not limited to, i) collision induced dissociation (CID); ii) electron capture dissociation (ECD); iii) electron transfer dissociation (ETD); iv) infrared multiphoton dissociation; v) blackdody infrared radiative dissociation.

It is also possible to perform simultaneous structural analysis by MS/MS of different mass/charge values and this has a very wide range of applications, for example, small molecule analysis of a complex mixture containing four different compounds with different mass/charge values. Monitoring of many compounds with different mass/charge values that cannot be adequately separated by a chromatography method could be undertaken using 2D MS/MS methodology such as Distance of Flight-Time of Flight MS/MS or Distance of Flight-Distance of Flight MS/MS.

It can be desirable to separate the temporal distributions of different mass/charge values at for example an o-TOF push pulse following batch ion extraction from a MLIT. Two different approaches are therefore possible: 1) fly the ions over a longer distance before the TOF section or 2) give the ions a mass/charge dependent K.E. on ejection from the ion trap. However, when increasing the flight path between the ion trap and the time of flight, the K.E. distribution prior to ion extraction will cause an increase in the spatial distribution of the ions with increasing distance flown following ion extraction. This implies that in order to increase the spatial separation of the ions using low K.E. batch ion extraction, that the separation in distance between the ion packets must be greater than the increasing packet width. In order to address this effect which is influenced by the ion packet physical characteristics (notably the size and K.E. distribution of the ion packet) the separation of the ion packets by oscillation of the ions in the ion trap prior to ejection was developed which increases the distance flown by different mass/charge ions prior to ion ejection and allows them to experience a different extraction field in the MLIT at the start of the batch ion extraction pulse depending on their axial position at that time.

Figure 25:
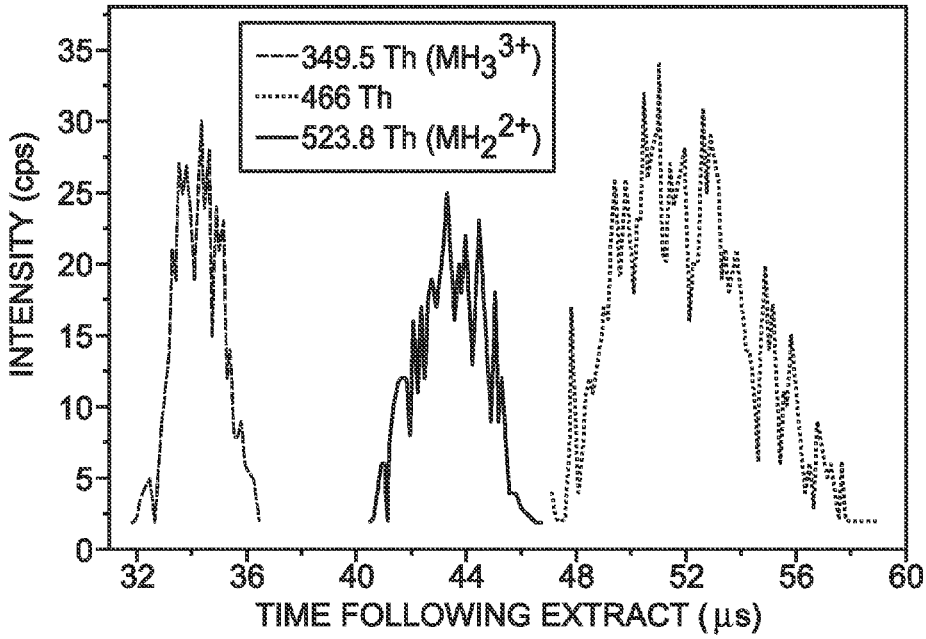
FIG. 25 is a plot showing the intensity of ions at the detector after exiting the miniature linear ion trap.

Ion oscillation has been studied using Simion 7.0 (FIG. 25) by focusing the ions in a symmetrical DC potential well then rendering it asymmetric. In FIG. 25 the resulting oscillations of three different mass/charge values 349.5 Th, 466 Th and 523.8 Th is illustrated. The black bar at 22 μs is present to illustrate the spatial distribution of the three different mass/charge values at this point due to a mass/charge dependent oscillation. It is worth noting that in this controlled oscillation of only 22 μs it is possible to induce a spatial difference between the 349.5 Th ion packet and the 466 Th ion packet of circa 0.5 mm (FIG. 25).

Figure 23:
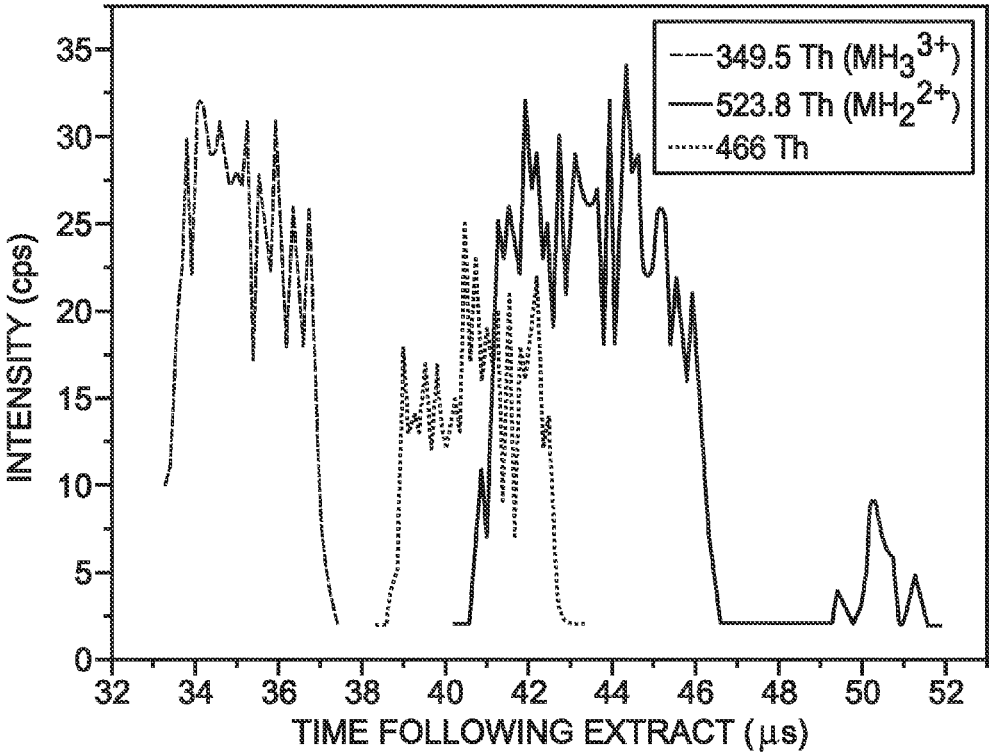
FIG. 23 is a plot showing the intensity of ions at the detector after exiting the miniature linear ion trap.
Figure 24:
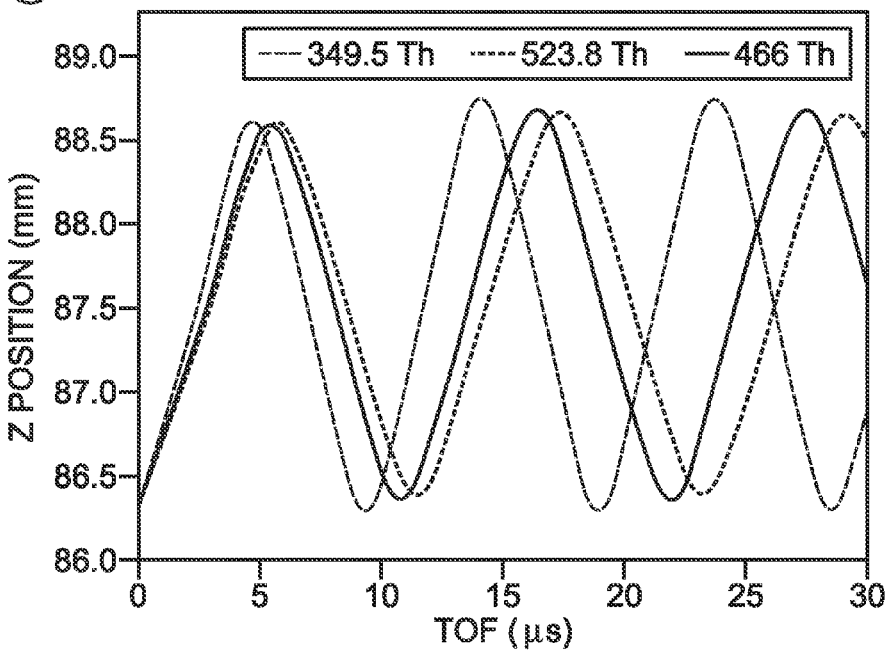
FIG. 24 is a plot of the ions undergoing different mass/charge frequency-related oscillations.

When the different mass/charge ion packets are ejected following oscillation it is possible to allow an increase or a decrease of the temporal distribution between the mass/charge values at the o-TOF push pulse. In FIG. 25 the separation between the ion packets has been increased by ejection of the 349.5 Th before the 466 Th and in turn before the 523.8 Th, compared to in FIG. 23. The separation is greater between the different mass/charge ion packets due to the 466 Th and 523.8 Th ion packets having to turn around before ejection from the MLIT towards the detector (detector is in the direction of the higher distance values in mm in FIG. 24). However, it is also possible to perform pulsed ejection of the ions where the heavier mass/charge ions are ejected first from the ion trap followed by the lighter mass/charge values. In this case, the lighter mass/charge ion packet will catch up with the heavier mass/charge ion packet at a specific distance allowing a focus point, which can be useful for orthogonal time of flight mass spectrometry where a large mass/charge range needs to be in the same TOF push space to be observed at the detector.

It is also possible to focus a large initial spatial distribution when using batch ion extraction to a point in space or time using the MLIT, when appropriate voltages are applied to the multipole rods and to the entrance and exit tubular lenses. It is worth noting that initial spatial distributions (prior to ejection from the MLIT) of as much as 3 mm (assuming no initial kinetic energy) have been focused to less than half this initial spatial distribution (only a few millimeters away from the tubular exit lens) on batch ion extracton from the MLIT (experiment performed using Simion 7).

Image Current Detection

In one embodiment, a method of image current detection including Fourier Transform analysis for the MLIT is shown. The method examines the forced oscillation of a coherent ion packet in the radial plane with the ions oscillating upwards and downwards between the electrodes. The frequencies of the ions to be determined are in the radial plane and perpendicular to the detector plates, therefore the measured frequencies would have minimum distortion.

In the MLIT with tubular lenses the image current detection is measured in the radial plane through the circuit as shown in FIG. 8 above and the use of segmented tubular lenses as shown in FIGS. 9-10 above. Ions do not need to leave the center of the MLIT in order to be detected where higher multipole fields are minimum. The detector plates would be in the region of the minimum in the quadrupole field. Insulating the tubular lenses as illustrated in FIG. 9 would further reduce the detection of the RF field. The RF field detected on the tubular lenses would be minimum for a perpendicular alignment with the multipole rods and would increase as this angle changes.

The ions are trapped in a quadrupole field in the radial direction and a parabolic DC potential well in the axial direction. Even if other higher multipole fields exist, the frequency of oscillation will be independent of the kinetic energy assuming the oscillation of the ion is in the center of the MLIT. Image current detection should be undertaken in a region where the ion frequency is independent of its KE.

In the MLIT, the ions oscillate in the radial plane in a quadrupole pseudo-potential well, but they remain very close to the entrance and exit lenses which can cause higher multipole fields to be formed. The use of a grid over the entrance and exit holes in the tubular lenses can help to reduce fields that can result. The tubular lenses in themselves can allow reduction of fringe fields from DC or AC voltages applied near the MLIT.

In one embodiment, ion oscillation can be undertaken in both the axial and radial planes allowing for low ion charge density in an MLIT. Oscillating the ions simultaneously in both the axial plane and radial plane should not affect the stability of the ion in the other plane, respectively. Both the radial and axial frequencies can be determined using segmented tubular lenses.

Figure 26:
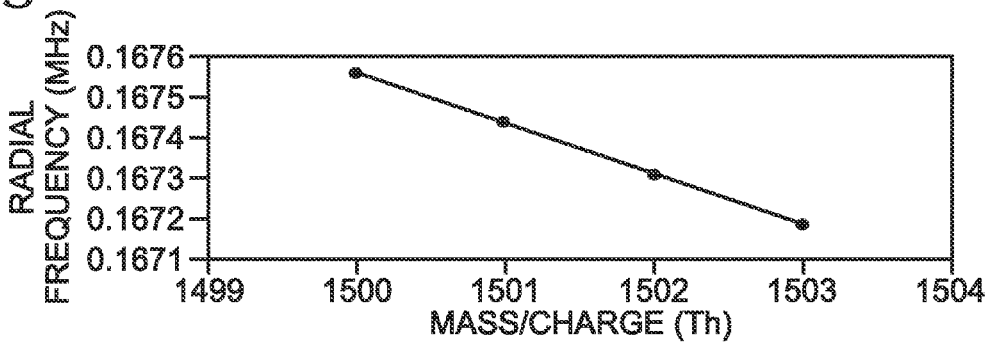
FIG. 26 is a plot of the change in radial oscillation frequency with mass/charge values.
Figure 27:
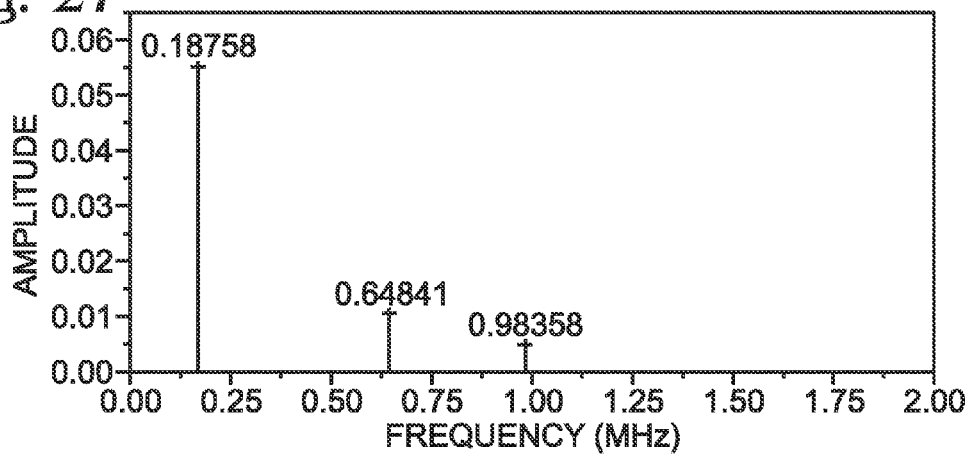
FIG. 27 is a Fourier transform of the radial oscillation.

Illustration of an example of simultaneous axial and radial oscillation allowing the measurement of the radial oscillation is illustrated in FIGS. 26 and 27 for ions of mass/charge of circa 1500Th illustrating the relatively high resolutions obtainable (base peak width less than 300 Hz and circa 100 Hz width at half height), despite a short detection time of only 22.8 ms (increase in the resolution is possible through the use of longer detection times). FIG. 26 illustrates the change in frequency with the increase in mass/charge from 1500Th to 1503Th. FIG. 27 illustrates a frequency $\omega$ at 0.16756 MHz, the RF frequency—0.16756 MHz ($\Omega-\omega$) at 0.64841 MHz and ($\Omega+\omega$) at 0.98358 MHz. It should be noted that the ions are oscillating with 0.25 eV in the axial and radial planes trapped in a 7V DC potential well (formed by application of 7V to the tubular lenses and without a DC offset voltage applied to the quadrupole rods). In the axial plane a DC potential well of 7V allows an ion distribution of 2.5 mm. The Fourier transform mass spectrum was obtained without grids on the tubular lenses. The two peaks a few Hertz before and after the peak 0.16756 MHz increase in intensity with wider DC potential wells. These two peaks become non-detectable in the FT-mass spectrum when narrower DC potential wells are used (causing the ion packet distribution to be further away from the tubular lenses).

In another embodiment, hyperbolic end caps are used with the MLIT rendering themselves closer to the ion packet enabling improved image current detection. In another embodiment, ion oscillation in the axial plane is improved through the use of grids over the lens holes as the entrance and exit lenses.

The MLIT allows focusing for mass analysers requiring an ion packet focused in time, space or kinetic energy. These include, but not limited to i) an Orbitrap; ii) a Penning trap; iii) Time of Flight; iv) Distance of Flight; v) a multipolar device such as a 3D ion trap, 2D ion trap or quadrupole. The coupling of several MLIT's in series to form a miniature triple quadrupole or to form other multiple stage devices is also possible and is advantageous for the development of portable mass spectrometers.

The small size of the MLIT can allow a wide range of pressures to be applied that allow its use as an interface between an atmospheric pressure source and the low pressures commonly used in a mass spectrometer.

It is possible to use a single collision gas such as Helium or Nitrogen with the MLIT or even multiple collision gases. It is also possible to pulse these gases so that the pressure or partial pressure of one or more of these gases changes throughout the analytical scan. The pressure or partial pressures can vary from atmospheric pressures to $1\times10^{-7}$ Torr. It should be noted that lower pressures or partial pressures are also possible.

According to one embodiment, the MLIT of the present disclosure could be used in conjuction with a distance of flight mass spectrometer for MS and simultaneous scanless MS/MS. A suitable distance of flight mass spectrometer is described in US Patent Application Publication No. 2005/0040326 A1, which is hereby incorporated by reference.

According to yet another embodiment, the MLIT of the present disclosure could be used in conjunction with a time of flight (TOF) mass spectrometer. For example, the MLIT could be used to trap the ions and could also reduce the ion packet dispersion on batch ion ejection when used prior to an orthogonal TOF mass spectrometer in order to allow all the ions to pass through the TOF at the same time.

It will be appreciated that the MLIT as described herein could be used to miniaturize existing devices. An exemplary device that could be miniaturized with the use of an MLIT is the triple quadrupole described in U.S. Pat. No. 4,234,791.

Various specific exemplary embodiments are described herein. However, it should be appreciated that actual dimensions and ranges may vary, according to the requirements of the specific apparatus being used and the goals therefore. Accordingly, such descriptions should be viewed as exemplary and no limitation inferred unless specifically recited in the claim.

What is claimed is:

1. A mass spectrometer instrument, comprising:

a miniature linear ion trap including at least one pair of multipole rods creating a trapping volume and applying an AC field to impose a radial pseudo-potential well on ions emitted from an ion source; the miniature linear ion trap further including:

an entrance lens located at one end of the miniature linear ion trap, the entrance lens including a tubular portion extending into the trapping volume within the space bounded by the sides and ends of the rods and towards the center of the miniature linear ion trap; and an exit lens located at the other end of the miniature linear ion trap, the exit lens including a tubular portion extending into the trapping volume within the space bounded by the sides and ends of the rods and towards the center of the miniature linear ion trap;

wherein a DC voltage is applied to both the entrance lens and the exit lens.

2. The mass spectrometer instrument of claim 1 wherein the miniature linear ion trap includes a length extending from the entrance lens to the exit lens selected from the group consisting of i) 0-2 mm; ii) 2-4 mm; iii) 4-6 mm; iv) 6-8 mm v) 8-10 mm; vi) 10-12 mm; vii) 12 -14 mm; viii) 14-16 mm ix) 16-18 mm x) 18-20 mm; xi) 20-22 mm; xii) 22-24 mm; xiii) 24-26 mm; xiv) 26-28 mm; xv) 28-30 mm; xvi) 30-32 mm; xvii) 32-34 mm; xviii) 34-36 mm; xix) 36-38 mm; xx) 38-40 mm xxi) 40-45 mm; xxii) 45-50 mm; xxiii) 50-55 mm.

3. The mass spectrometer instrument of claim 1 wherein at least one of the entrance lens and the exit lens is composed of a dielectric material.

4. The mass spectrometer instrument of claim 1 wherein the miniature linear ion trap allows $MS^n$ analysis.

5. The mass spectrometer instrument of claim 1 wherein the DC voltages applied to the miniature linear ion trap are such that focusing occurs in space, time or kinetic energy, following batch ion extraction.

6. The mass spectrometer of claim 1 wherein the tubular portions extending into the multipole volume are of lengths selected from the group consisting of i) 0-2 mm; ii) 2-4 mm; iii) 4-6 mm; iv) 6-8 mm v) 8-10 mm; vi) 10-12 mm; vii) 12-14 mm; viii) 14-16 mm ix) 16-18 mm x) 18-20 mm; xi) 20-22 mm; xii) 22-24 mm; xiii) 24-26 mm; xiv) 26-28 mm; xv)

28-30 mm; xvi) 30 -32 mm; xvii) 32-34 mm; xviii) 34-36 mm; xix) 36-38 mm; xx) 38-40 mm xxi) 40-45 mm; xxii) 45-50 mm; xxiii) 50-55 mm.

7. The mass spectrometer of claim 1 wherein the miniature linear ion trap is used as a device enabling the transfer of ions from a high pressure region to a lower pressure region in a mass spectrometer.

8. The mass spectrometer of claim 1 wherein resonant excitation or extraction of a single or multiple mass/charge ranges occurs through application of a supplementary AC voltage occurs in either the radial or axial planes.

9. The mass spectrometer of claim 1 wherein a gas is pulsed into the MLIT.

10. The mass spectrometer of claim 1 a gas is used allowing collisional ion focusing.

11. The mass spectrometer instrument of claim 1 further comprising an ion focusing device coupled to the miniature linear ion trap.

12. The mass spectrometer instrument of claim 11 wherein the ion focusing device includes a device capable of analyzing ions according to their mass/charge value.

13. The mass spectrometer instrument of claim 11 wherein the ion focusing device allows MS″ or MS capabilities.

14. The mass spectrometer instrument of claim 1 wherein the potential at the entrance lens is a different voltage from the exit lens.

15. The mass spectrometer instrument of claim 1 wherein a voltage applied to at least one of the entrance lens and the exit lens induces an ion oscillation.

16. The mass spectrometer instrument of claim 1 wherein the miniature linear ion trap includes means for obtaining a desired spatial dispersion of ions of different mass/charge values.

17. The mass spectrometer instrument of claim 1 wherein the entrance and exit lenses include holes that allow ions to enter and exit the MLIT and wherein at least one of the holes is covered by a grid.

18. The mass spectrometer instrument of claim 1 wherein the DC voltages applied to the entrance and exit lenses create an axial potential well in the trapping volume.

19. The mass spectrometer instrument of claim 18 wherein the shape of an axial potential well formed by the entrance lens and the exit lens is substantially symmetric about the center of the miniature linear ion trap.

20. The mass spectrometer instrument of claim 18 wherein the shape of an axial potential well formed by the entrance lens and the exit lens is substantially parabolic at the center of the miniature linear ion trap.

21. The mass spectrometer instrument of claim 1 wherein the DC voltages applied to the entrance and exit lenses create a field gradient which ejects the ions from the trapping volume.

22. A mass spectrometer for analyzing ions, comprising:

a miniature linear ion trap including multipole rods emitting AC fields to trap ions within a trapping volume;

an entrance lens located at one end of the miniature linear ion trap, the entrance lens including a tubular portion extending within the space bounded by the sides and ends of the rods and towards the center of the miniature linear ion trap; and an exit lens located at the other end of the miniature linear ion trap, the exit lens including a tubular portion extending within the space bounded by the sides and ends of the rods and towards the center of the miniature linear ion trap;

wherein the entrance and exit lenses include electrodes to detect the image current of the ions.

23. The mass spectrometer of claim 22 wherein the image current is detected in the radial direction.

24. A method of analyzing mass in a spectrometer, comprising:

providing a miniature linear ion trap including:

at least one pair of multipole rods arranged substantially 180 degrees from each other for creating a trapping volume;

an entrance lens located at one end of the miniature linear ion trap, the entrance lens including a tubular portion extending within the space bounded by the sides and ends of the rods and towards the center of the miniature linear ion trap; and an exit lens located at the other end of the miniature linear ion trap, the exit lens including a tubular portion extending within the space bounded by the sides and ends of the rods and towards the center of the miniature linear ion trap;

admitting ions through a tubular entrance lens into the trapping volume;

applying an AC field to impose a radial pseudo-potential well on ions emitted from an ion source; and applying DC voltages to the tubular entrance lens and the tubular exit lens.

25. The method of claim 24 wherein the miniature linear ion trap includes a length extending from the tubular entrance lens to the tubular exit lens of less than 30 mm.

26. The method of claim 24 further comprising coupling an ion focusing device to the miniature linear ion trap.

27. The method of claim 24 further comprising applying a DC voltage gradient between the tubular entrance lens and the tubular exit lens.

28. The method of claim 27 wherein the DC voltages gradient ejects the ions from the trapping volume.

29. The method of claim 24 further comprising providing gas to the miniature linear ion trap for collisional cooling of ions.

30. The method of claim 24 further comprising detecting image current using electrodes located in the tubular entrance lens and the tubular exit lens.

31. The method of claim 24 further comprising ejecting ions by applying an AC frequency such that the ions enter into resonance.

32. The method of claim 24 further comprising ejecting ions by applying a combination of an AC frequency and a DC field gradient such that the ions enter into resonance and are ejected predominantly in the direction of a detector.

33. The method of claim 24 further comprising applying different DC voltages to different multipole rods.

34. The method of claim 33 wherein the different DC voltages are applied to allow a coherent oscillation in the radial plane.

35. The method of claim 33 wherein the different DC voltages are applied such that ions oscillate in an induced coherent packet in the axial plane.

36. The method of claim 33 further comprising applying a combination of AC, DC, and RF voltages to different electrodes in the MLIT.

37. The method of claim 36 where the AC, DC, and RF voltages are selected such that ions of different mass/charge values are ejected from the MLIT with different kinetic energies.

38. The method of claim 36 where the AC, DC, and RF voltages are selected such that ions of different mass/charge values are ejected from the MLIT with substantially similar kinetic energies.

39. The method of claim 24 further comprising:

i) selecting a range of mass/charge values with the MLIT; and ii) sending the ions to a second mass/charge analyzer.

40. The method of claim 24 further comprising applying DC voltages to the entrance and exit lenses relative to the DC offset applied to the multiple rods.

41. The method of claim 40 wherein the applied DC voltage allows the formation of a symmetrical DC axial potential well.

42. The method of claim 40 wherein the applied DC voltage allows the formation of an asymmetrical DC axial potential well.

43. The method of claim 40 wherein the difference between the DC offset and the DC voltage applied to either the entrance lens or the exit lens is selected from the group consisting of: 0-10V, 10-20V, 20-30V, 30-40V, 40-50V, 50-60V, 60-70V, 70-80V, 80-90V, 90-100V, 100-110V, 110-120V, 120-130V, 130-140V, 140-150V, 150-160V, 160-170V.

44. The method of claim 40 wherein the difference between the DC offset and the DC voltage applied to either the entrance lens or the exit lens is between 170 and 500V.

45. The method of claim 40 wherein the difference between the DC offset and the DC voltage applied to either the entrance lens or the exit lens is greater than 500V.

46. The method of claim 24 wherein the DC voltages applied to the entrance and exit lenses create an axial potential well in the trapping volume.

47. The method of claim 46 further comprising applying a pulse to induce ion oscillation in the axial potential well.

* * * * *